US008019268B2

(12) United States Patent
Nakamatsu et al.

(10) Patent No.: US 8,019,268 B2
(45) Date of Patent: Sep. 13, 2011

(54) POLARITY CONTROLLING DEVICE, AND CLEANER AND IMAGE FORMING APPARATUS USING THE POLARITY CONTROLLING DEVICE

(75) Inventors: Hiroki Nakamatsu, Fujisawa (JP); Kenji Sugiura, Yokohama (JP); Naomi Sugimoto, Kawasaki (JP); Osamu Naruse, Yokohama (JP); Hidetoshi Yano, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 67 days.

(21) Appl. No.: 12/507,326

(22) Filed: Jul. 22, 2009

(65) Prior Publication Data

US 2010/0034549 A1 Feb. 11, 2010

(30) Foreign Application Priority Data

Aug. 8, 2008 (JP) ..... 2008-206442

(51) Int. Cl.
*G03G 21/00* (2006.01)
*G03G 15/16* (2006.01)

(52) U.S. Cl. ..... 399/349; 399/101; 399/350; 399/354

(58) Field of Classification Search ..... 399/71, 399/101, 343, 349, 350, 354
See application file for complete search history.

(56) References Cited

U.S. PATENT DOCUMENTS 5,701,571 A * 12/1997 Amamiya et al. ..... 399/343
7,471,924 B2 * 12/2008 Shigezaki et al. ..... 399/349
2007/0212139 A1 9/2007 Sugiura et al.
2008/0170878 A1 7/2008 Yamashita et al.
2008/0193178 A1 8/2008 Sugimoto et al.
2008/0193179 A1 8/2008 Sugimoto et al.
2008/0253815 A1 10/2008 Yano et al.
2008/0310897 A1 12/2008 Naruse et al.
2009/0035038 A1 2/2009 Sugimoto et al.
2009/0092428 A1 4/2009 Yano et al.

FOREIGN PATENT DOCUMENTS

JP 09-127846 * 5/1997
JP 2002-202702 7/2002
JP 2002-268494 9/2002
JP 2004-272019 9/2004
JP 2005-265907 9/2005

* cited by examiner

*Primary Examiner* — Sandra L Brase
(74) *Attorney, Agent, or Firm* — Oblon, Spivak, McClelland, Maier & Neustadt, L.L.P.

(57) ABSTRACT

A polarity controlling device for controlling polarity of residual material on an image bearing member, including a blade, to which a first voltage is applied and which has a contact edge contacted with the surface of the image bearing member to charge the residual material, wherein the contact edge is covered with a resin layer including an electroconductive material. A cleaner including the polarity controlling device; a brush contacting the image bearing member to electrostatically collect the charged residual material utilizing potential difference; a collection member contacting the brush to collect the residual material; and a cleaning blade contacting the collection member to scrape the residual material therefrom. An image forming apparatus including an electrostatic image bearing member; a developing device developing the electrostatic image using a developer including a toner to form a toner image; a transfer device transferring the toner image onto a receiving material; and the cleaner.

14 Claims, 19 Drawing Sheets

POLARITY CONTROLLING DEVICE, AND CLEANER AND IMAGE FORMING APPARATUS USING THE POLARITY CONTROLLING DEVICE

BACKGROUND OF THE INVENTION

1. Field of the Invention

The present invention relates to a polarity controlling device. In addition, the present invention also relates to a cleaner and an image forming apparatus using the polarity controlling device.

2. Discussion of the Background

Recently, an increasing need exists for electrophotographic images with high image qualities (particularly, high resolution). Therefore, the particle diameter of toner, which is used for forming visual images in electrophotography, becomes smaller and smaller. On the other hand, a need exists for toner having low manufacturing costs and high transfer rate. In order to fulfill such a need, spherical toner prepared by a polymerization method has been used for electrophotographic image forming apparatus.

Electrophotographic image forming apparatus typically use a cleaner including a blade, which removes toner particles having a charge and remaining on the surface of an image bearing member (such as photoreceptors) even after a toner image on the photoreceptor is transferred. In such a blade cleaning method, a rubber blade is contacted with the surface of the photoreceptor. In this case, if the blade is not well contacted with the surface of the photoreceptor (i.e., if contact between the cleaning blade and the photoreceptor lacks precision), toner particles to be removed by the blade often pass through the nip between the blade and the photoreceptor, resulting in occurrence of a background development problem in that the background of a toner image formed on a receiving material sheet is soiled with such residual toner particles.

In this regard, when the cleaning blade is contacted with the photoreceptor at a high pressure in attempting to avoid such a background development problem, another problem which occurs is that the tip of the cleaning blade is turned in the opposite direction, and thereby a streak of toner particles, which are not removed by the blade, is formed on the surface of the photoreceptor, resulting in formation of an abnormal streak image.

Even when spherical toner is used, residual toner particles on a photoreceptor can be typically removed if the contact pressure of a cleaning blade is extremely high (specifically, not less than 100 gf/cm (i.e., 0.98 N/cm) in a linear pressure). However, in this case, a problem in that the lives of the photoreceptor and the cleaning blade shorten occurs.

In this regard, under normal conditions such that the contact pressure of a cleaning blade is 20 gf/cm (0.196 N/cm) and the diameter of the photoreceptor is 30 mm, the life of the photoreceptor is about 100 kp (1 kp=1,000 sheets of copy), and the life of the blade is about 120 kp. In contrast, when the contact pressure of the blade is 100 gf/cm, each of the lives of the photoreceptor and the blade is decreased to about 20 kp.

It is well known that spherical toner has good transfer properties but the cleaning property thereof is inferior to that of pulverization toner, which has irregular particle forms.

Instead of such blade cleaning methods, brush cleaning methods are used for removing toner particles. By using brush cleaning methods, abrasion of the surface of a photoreceptor can be reduced, and small and spherical toner particles can be well removed. An example of brush cleaning methods uses a brush contacted with the photoreceptor while rubbing the photoreceptor to collect residual toner particles on the photoreceptor, a toner collection roller contacted with the brush to collect the toner particles from the brush, and a blade (such as rubber blades) configured to remove the toner particles from the toner collection roller.

In this example brush cleaning method, a voltage is applied to the toner collection roller or both of the toner collection roller and the brush to perform cleaning using an electrostatic force. Therefore, the brush cleaning method is effective for removing spherical toner. However, in general, a voltage having a polarity opposite to the polarity of the toner used is applied in an image transfer process, in which a toner image on the photoreceptor is transferred to a receiving material, and therefore toner particles remaining on the photoreceptor after the image transfer process are a mixture of particles maintaining the original polarity, particles having the opposite polarity and particles having no polarity.

In attempting to remove such residual toner particles having a variety of polarities, a published unexamined Japanese patent application No. (hereinafter referred to as JP-A) 2005-265907 discloses a cleaning method in which residual toner particles are charged by a corona charger (i.e., a corotron charger) to control the polarity of the residual toner particles before the cleaning process, and the charged residual toner particles are then collected with two brushes, which are arranged side by side and to which positive and negative voltage are respectively applied. However, the cleaning device has to have two brushes and two toner collection devices, and thereby the size of the image forming apparatus is increased.

Recently, a need exists for miniaturized image forming apparatus. In order to fulfill the need, the diameter of the photoreceptor drum serving as an image bearing material becomes smaller and smaller. Therefore, the cleaning device used for the image forming apparatus has to be miniaturized. In attempting to fulfill the need, a relatively small cleaning device, in which a toner polarity controlling blade, to which a voltage is applied, is arranged to control the polarity of residual toner particles, and an electrostatic cleaning device is arranged on a downstream side from the blade to electrostatically collect the toner particles charged so as to have a positive or negative polarity, is proposed.

An example of the electrostatic cleaning device is that a brush roller and a collection roller are arranged while applying a voltage to the brush roller so that a potential difference is formed therebetween and thereby residual toner particles are adhered to the brush roller from the photoreceptor.

In such electrostatic cleaning methods, it is preferable that the charge distribution (i.e., q/d distribution) of the thus polarity-controlled residual toner particles falls in a certain range. In this regard, q represents the charge quantity of a toner particle and d represents the particle diameter of the toner particle. In this application, detailed explanation of charging of toner particles in an electrostatic cleaning device is omitted. However, charge injection to toner particles is basically caused although the quantity of the injected charge changes depending on the potential difference between the photoreceptor drum and the cleaning brush and the potential difference between the cleaning brush and the toner collection roller.

Therefore, the q/d distribution curve of the polarity-controlled toner particles is preferably present slightly apart from the point 0 fC/μm. Specifically, when the polarity of the charged residual toner particles is controlled to be negative, the lower end of the q/d distribution curve is preferably −0.2 fC/μm. In this case, the polarity of the toner particles is not changed (i.e., the negative polarity is maintained) even when the above-mentioned charge injection is caused.

The upper end of the q/d distribution curve is preferably −0.8 fC/μm. When the negative charge quantity of the charged residual toner particles increases, the attraction between the photoreceptor drum and the toner particles thereon increases, and therefore it becomes difficult to remove the toner particle from the photoreceptor. Therefore, the upper end of the q/d distribution curve is preferably −0.8 fC/μm. Thus, the q/d distribution curve of the charged residual toner particles preferably falls in a range of from −0.2 fC/μm to −0.8 fC/μm. In this case, the residual toner particles can be well removed from the photoreceptor.

However, conventional toner polarity controlling blades for controlling the polarity of toner have the following drawbacks (a)-(d).

(a) As illustrated in FIGS. 20A-20C (FIG. 20A illustrates the initial state), the width of the nip between a toner-polarity controlling blade 220 and a photoreceptor 100 changes as time elapses due to repetition of sticking and slipping of the blade at the nip. This is because such toner-polarity controlling blades typically have a relatively high friction coefficient. In this case, the amount of charge injected by the blade changes, and therefore the q/d distribution of toner particles (t) broadens to such a degree as not to fall in the targeted range of from −0.2 fC/μm to −0.8 fC/μm as illustrated in FIG. 21.

(b) As illustrated in FIG. 22A, one of the toner polarity controlling blades 220, which have been used for controlling the polarity of toner, is set on a setting table 221, and the tip edge of the blade is observed with a laser microscope 250 to determined the degree of abrasion of the tip edge. In FIG. 22A, character (a) denotes the field of view of the laser microscope 250. FIG. 22B is an enlarged view of the portion (a) in FIG. 22A. As illustrated in FIG. 22B, the tip edge portion of the blade 220 is abraded, wherein the edge in the initial state is illustrated by a dotted line. The profile of the tip edge portion is illustrated in FIG. 23. In FIG. 23, the tip edge in the initial state is also illustrated by a dotted line. Therefore, as illustrated in FIGS. 24A and 24B, the toner particles (t) pass through an abraded portion (b) of the blade 220. Accordingly, charges cannot be injected to the toner particles passing through the abraded portion (b), resulting in broadening of the q/d distribution to such a degree as not to fall in the targeted range of from −0.2 fC/μm to −0.8 fC/μm as illustrated in FIG. 25. In FIG. 25, the toner particles to which charges are not injected have a q/d distribution curve (sub-peak) around 0 fC/μm.

(c) As illustrated in FIG. 26A, some of toner particles having a polarity opposite to that of the voltage applied to the blade are attracted to the toner-exit-side of the blade. Since conventional toner polarity controlling blades typically have a poor toner releasability, the toner particles adhered to the blade are not removed therefrom even when the blade repeats sticking and slipping. In this regard, the blade having the "sticking" state is illustrated in FIG. 26B, and the blade having the "slipping" state is illustrated in FIG. 26C. In this case, the charge injection cannot be well performed by the blade, and therefore the q/d distribution curve broadens to such a degree as not to fall in the targeted range of from −0.2 fC/μm to −0.8 fC/μm as illustrated in FIG. 25.

(d) Urethane resins are typically used for conventional toner polarity controlling blades. In addition, in order to control the resistivity of the blades, electroconductive materials are included therein. Since electroconductive materials cannot be well dispersed in urethane resins, the resistivity of such conventional toner polarity controlling blades largely varies, resulting in broadening of the q/d distribution curve to such a degree as not to fall in the targeted range of from −0.2 fC/μm to −0.8 fC/μm as illustrated in FIG. 21.

Thus, the q/d distribution of residual toner particles, to which charges are injected by such conventional toner polarity controlling blades, tends to fall out of the targeted range of from −0.2 fC/μm to −0.8 fC/μm. Therefore, the residual toner particles cannot be well removed from the photoreceptor by a cleaning brush, which is located on the downstream side from the toner polarity controlling blade 220 (or 22). When materials in which electroconductive materials can be well dispersed are used for the toner polarity controlling blade, another problem in that the physical properties of the blade deteriorate, and thereby the blade cannot be practically used occurs.

JP-A 2004-272019 discloses a cleaning device using a blade having an edge, which is to be contacted with a photoreceptor and which has an angle greater than 90°. However, JP-A 2004-272019 does not disclose or suggest resin coating of such a blade having an edge having an angle greater than 90°.

Because of these reasons, a need exists for a toner polarity controlling device, which stably controls the polarity of residual toner particles so that the residual toner particles can be well removed from an image bearing member such as photoreceptors by an electrostatic cleaning method in order to prolong the life of the image bearing member and to produce high quality images.

SUMMARY OF THE INVENTION

As an aspect of the present invention, a polarity controlling device for controlling the polarity of a residual material on an image bearing member is provided. The polarity controlling device includes a blade, to which a voltage is applied and which has a contact edge contacted with the surface of the image bearing member to charge the residual material so as to have a charge with a polarity when the residual material pass through the nip between the contact edge of the blade and the surface of the image bearing member, wherein the contact edge of the blade is covered with a resin layer (cover layer), which includes a resin and an electroconductive material dispersed in the resin.

As another aspect of the present invention, a cleaner is provided, which includes:

the above-mentioned polarity controlling device; and a brush, to which a second voltage having a second polarity opposite to the polarity of the voltage applied to the blade of the polarity controlling device is applied and which contacts the image bearing member to electrostatically collect the residual material on the surface of the image bearing member after the residual material is charged by the blade of the polarity controlling device;

a collection member, to which a third voltage having the second polarity and being greater than the second voltage is applied and which contacts the brush to electrostatically collect the residual material on the surface of the brush; and a collection member cleaning blade, to which a fourth voltage having the second polarity and being greater than the third voltage is applied and which contacts the collection member to scrape the residual material from the surface of the collection member.

As yet another aspect of the present invention, an image forming apparatus is provided, which includes:

an image bearing member configured to bear an electrostatic image thereon;

a developing device configured to develop the electrostatic image with a developer including a toner to form a toner image on the image bearing member;

a transfer device configured to transfer the toner image onto a receiving material; and the above-mentioned cleaner configured to remove the residual material on the image bearing member.

The image forming apparatus may have plural sets of image bearing members and cleaners, and/or plural developing devices to produce multi-color images.

The image bearing member and the above-mentioned cleaner may be unitized in the image forming apparatus as a process cartridge, which optionally includes one or more other members selected from chargers configured to charge the image bearing member and the developing device. The process cartridge is detachably attachable to the image forming apparatus.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, the image forming apparatus of the present invention will be explained.

Recently, a need exists for an electrophotographic image forming apparatus capable of producing high resolution images. In order to fulfill the need, toner having a relatively small particle diameter is used. In addition, in order to increase the transfer rate of toner images in the image transfer process, toner having a particle form near spherical form has been used instead of conventional toner having irregular forms. When such small and spherical toner is used, it is hard to remove residual toner particles from an image bearing member using a blade because the toner particles easily pass through the nip between the tip of the blade and the surface of the image bearing member. In order to make the advantages of the small and spherical toner such that high quality images can be produced, a cleaner-less image forming method is proposed therefor.

When a pressure applied to a cleaning blade contacted with an image bearing member is increased so as to be 100 gf/cm or more, such small and spherical toner can be removed from the image bearing member. However, in this case, the image bearing member and the cleaning blade are serious abraded, resulting in shortening of the lives of the image bearing member and the cleaning blade. As mentioned above, under normal conditions such that the contact pressure of a blade is 20 gf/cm (0.196 N/cm) and the diameter of a photoreceptor contacted with the blade is 30 mm, the life of the photoreceptor is about 100 kp, and the life of the blade is about 120 kp. In this regard, the life of the photoreceptor is defined as the time when one third of the photosensitive layer is abraded, and the life of the blade is defined as the time when a cleaning problem occurs due to abrasion of the blade. In contrast, when the contact pressure of the blade is 100 gf/cm, each of the lives of the photoreceptor and the blade is decreased to about 20 kp.

As mentioned above, electrostatic cleaning methods have been proposed and used for removing such spherical toner from an image bearing member.

In the present application, a blade whose surface is coated with a resin, in which an electroconductive material is dispersed, is used. In this case, the blade has relatively low friction coefficient, high hardness, good toner releasability, and good resistance stability, and thereby the polarity of residual toner particles can be stably controlled, resulting in good performance of electrostatic cleaning and production of high quality images. In addition, the lives of the blade and the image bearing member can be extended.

Example 1

One example of the image forming apparatus will be explained.

At first, the structure of the example will be explained by reference of FIG. 1.

Figure 1:
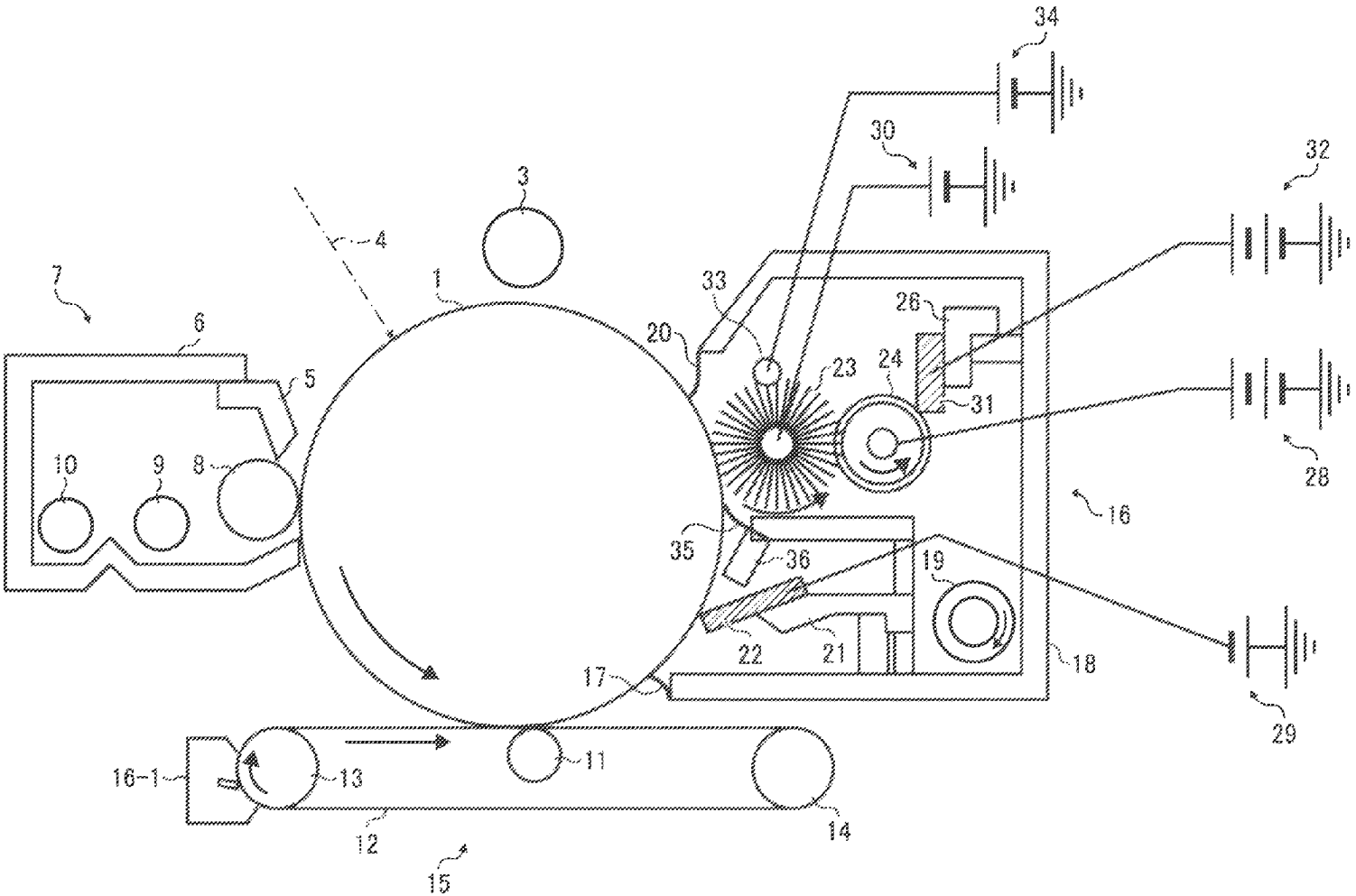
FIG. 1 is a schematic view illustrating the main portion of a monochrome image forming apparatus according to an embodiment of the present invention.

FIG. 1 illustrates a monochrome image forming apparatus having only one developing device.

Referring to FIG. 1, the image forming apparatus includes a photoreceptor 1 serving as an image bearing member and having a drum form. Around the photoreceptor 1, a non-contact charging roller 3, which charges the surface of the photoreceptor, a developing device 7, which develops an electrostatic image formed on the photoreceptor with a developer including a toner to form a toner image on the photoreceptor, a transfer device 15, which transfers the toner image to a receiving material sheet, and a cleaner 16, which cleans the surface of the photoreceptor, are arranged in this order in the rotation direction of the photoreceptor 1. A laser beam 4 emitted by a light irradiator (not shown) irradiates the charged photoreceptor 1 at a position between the charging roller 3 and the developing roller 7 to form an electrostatic image on the photoreceptor.

The developing device 7 includes a case 6, a developing roller 8 arranged to be close to the photoreceptor 1 while opposed thereto, a doctor blade 5 arranged in the vicinity of the developing roller 8 to form a developer layer on the developing roller, and first and second developing screws 9 and 10 configured to supply the developer to the developing roller 8 while agitating the developer.

The transfer device 15 includes a transfer belt 12 configured to feed a receiving material sheet via a transfer portion (transfer nip), at which a toner image on the photoreceptor 1 is transferred to the receiving material sheet, support rollers 13 and 14 configured to support the transfer belt for at both sides thereof, a driving device configured to drive (not shown) one of the support rollers, a transfer roller 11, which is contacted with the inside of the intermediate point (i.e., transfer portion) of the transfer belt 12 while rotated to press the transfer belt to the photoreceptor 1, etc.

The image forming apparatus includes a feeding device (not shown in FIG. 1), which is located on the left side of the feeding belt 12 to feed sheets of the receiving material one by one toward the transfer device 15. The receiving material sheet fed from the feeding device is fed by the transfer belt 12 while borne thereby so that a toner image on the photoreceptor 1 is transferred to the receiving material sheet by the transfer roller 11. The receiving material sheet bearing the toner image thereon is further fed by the transfer belt 12 so that the toner image is fixed thereon by a fixing device (not shown) located on the right side of the transfer device 15. The receiving material sheet bearing the fixed toner image thereon is then discharged from the image forming apparatus.

Next, the polarity controlling device and cleaning device of the image forming apparatus will be explained.

The cleaner 16 is configured to remove a residual material (such as residual toner particles) from the photoreceptor 1. A cleaner 16-1 having substantially the same structure as that of the cleaner 16 is arranged so as to face the support roller 13 to remove a residual material (such as residual toner particles), which is typically transferred from the photoreceptor 1, from the transfer belt 12.

The cleaner 16 includes a cleaner case 18 and the below-mentioned cleaning members contained in the case. Specifically, the cleaner 16 includes, as the cleaning members, a cleaner entrance seal 17, a toner polarity controlling blade 22, a discharging lamp 36, a brush entrance seal 35, a cleaning brush 23 serving as a remover configured to remove a charged residual material, which has been charged by the toner polarity controlling blade, from the photoreceptor 1, a cleaner exit seal 20, etc., which are arranged in this order in the rotation direction of the photoreceptor. The cleaning members except for the discharging lamp 36 are arranged so that the tips thereof are contacted with the photoreceptor 1. The toner polarity controlling blade 22 is supported by a blade holder 21 in such a manner that the tip thereof is contacted with the peripheral surface of the photoreceptor 1 while rubbing the surface. The toner polarity controlling blade 22 is connected with a polarity controlling power source 29 (i.e., a power source for applying a voltage to the toner polarity controlling blade 22).

In addition, the cleaner 16 includes a collection roller 24 configured to receive the residual material collected by the brush 23, a charge supplying member 33 having a rod-shape and configured to apply a voltage to the brush, and a collection roller cleaning blade 31, which is supported by a holder 26 and which is configured to remove the residual material from the surface of the collection roller 24. Further, the cleaner 16 includes a discharging screw 19, which is located on a bottom portion of the cleaner case 18 and which is configured to discharge the collected residual material from the cleaner case. Furthermore, power sources 29, 34, 30, 28 and 32 are respectively connected with the toner polarity controlling blade 22, the charge supplying member 33, a shaft of the cleaning brush 23, a shaft of the collection roller 24, and the collection roller cleaning blade 31 to apply respective voltages thereto.

Next, the image bearing member of the image forming apparatus will be explained.

In this example, the photoreceptor 1, which is an amorphous silicon photoreceptor, is used as the image bearing member. Such an amorphous silicon photoreceptor can be prepared, for example, by forming an amorphous silicon layer on an electroconductive substrate, which is heated to a temperature of from 50 to 400° C., using a film forming method such as vapor deposition methods, sputtering methods, ion plating methods, thermal CVD (chemical vapor deposition) methods, optical CVD methods, and plasma CVD methods. Among these methods, plasma CVD methods such that a raw material (gas) is decomposed by a glow discharge using a DC, high frequency waves or microwave to deposit amorphous silicon on a substrate are preferably used.

The photoreceptor 1 can have such layer structures as illustrated in FIGS. 2A-2D. A photoreceptor 500 illustrated in FIG. 2A includes a substrate 501 and a photosensitive layer 502 located on the substrate and including amorphous-Si:H, X, wherein H represents a hydrogen atom and X represents a halogen atom (i.e., F, Cl, Br and I).

Figure 2A:
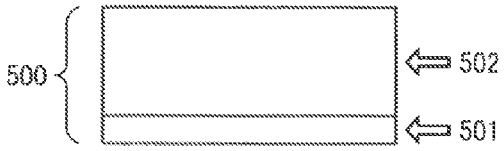
FIGS. 2A-2D are schematic views illustrating the cross sections of photoreceptors serving as an image bearing member of the image forming apparatus illustrated in FIG. 1.
Figure 2B:
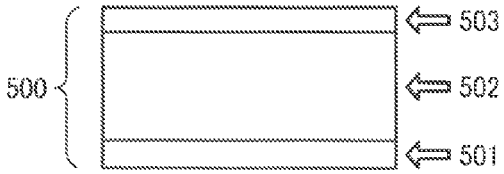

The photoreceptor 500 illustrated in FIG. 2B includes the substrate 501, photosensitive layer 502, and an amorphous-Si outermost layer 503 including an amorphous silicon and located on the photosensitive layer.

Figure 2C:
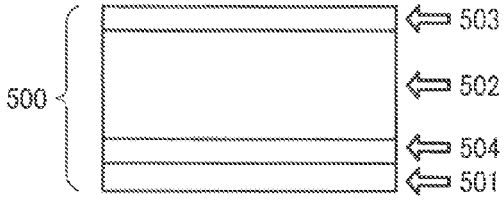

The photoreceptor 500 illustrated in FIG. 2C includes the substrate 501, photosensitive layer 502, amorphous-Si outermost layer 503, and an amorphous-Si-containing charge injection blocking layer 504 configured to prevent charge injection from the substrate 501.

Figure 2D:
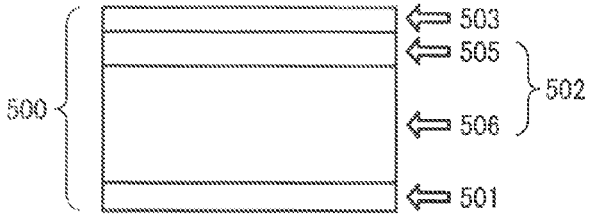

The photoreceptor 500 illustrated in FIG. 2D has a layer structure similar to that of the photoreceptor 500 illustrated in FIG. 2B except that the photosensitive layer 502 includes an amorphous-Si-containing charge generation layer 505 and an amorphous-Si-containing charge transport layer 506.

The substrate 501 may be an electroconductive or insulating material. Specific examples of the electroconductive material includes metals such as Al, Cr, Mo, Au, In, Nb, Te, V, Ti, Pt, Pd and Fe, and metal alloys of such metals (such as stainless steels). Specific examples of the insulating material include films of resins such as polyesters, polyethylene, polycarbonate, cellulose acetate, polypropylene, polyvinyl chloride, polystyrene, and polyamides; glass; and ceramics. An electroconductive layer is formed on at least one side of such insulating materials, which is to be contacted with the photosensitive layer. Specific examples of the shape of the substrate include drum shapes, plate shapes, and endless belt shapes. The thickness of the substrate 501 is determined so that the resultant photoreceptor 500 (or 1) has the predetermined properties. For example, when a flexible photoreceptor is needed, a flexible material such as resin films is preferably used. In this regard, the thickness is preferably not less than 10 μm in view of the mechanical strength of the resultant photoreceptor.

The amorphous-Si photoreceptor for use in the image forming apparatus preferably includes the charge injection blocking layer 504 between the substrate 501 and the photosensitive layer 502 as illustrated in FIG. 2C. The charge blocking layer 504 has a function of blocking injection of charges to the photosensitive layer 502 from the substrate 501 when the surface of the photoreceptor 500 (or 1) is subjected to a charging treatment so as to have a charge with a predetermined polarity. When the surface of the photoreceptor 500 (or 1) is subjected to the opposite polarity charging treatment, the charge blocking layer 504 does not carry out such a function. Namely, the charge injection blocking layer 504 has a dependence on polarity. In order to impart such a function to the charge injection blocking layer 504, atoms capable of controlling the conductivity of the layer are included in the layer in a relatively large amount compared to that for the photosensitive layer. The thickness of the charge injection blocking layer 504 is determined so that the resultant photoreceptor can achieve the desired properties at a minimum cost, and is preferably from 0.1 μm to 5 μm, more preferably from 0.3 μm to 4 μm, and even more preferably from 0.5 μm to 3 μm.

Next, the photosensitive layer will be explained. The photosensitive layer 502 is formed on the substrate 501 with or without a layer (such as the charge injection blocking layer 504) therebetween. The thickness of the photosensitive layer 502 is determined in consideration of the properties of the resultant photoreceptor and economic effects, and is preferably from 1 μm to 100 μm, more preferably from 20 μm to 50 μm, and even more preferably from 23 μm to 45 μm.

The photosensitive layer 502 is preferably a functionally-separated photosensitive layer including the charge generation layer 505 and the charge transport layer 506.

The charge transport layer 506 has a function of transporting charge carriers generated by the charge generation layer 505. The charge transport layer 506 typically includes a silicon atom, a carbon atom and a fluorine atom, and optionally includes a hydrogen atom and an oxygen atom. Namely, the charge transport layer 506 includes an amorphous-SiC (H,F, O) material, and has the predetermined photosensitive properties, particularly, a combination of charge retaining property, charge generating property, and charge transporting property. The amorphous-Si photosensitive material of the photoreceptor for use in the image forming apparatus of the present invention preferably includes an oxygen atom. The thickness of the charge transport layer 506 is determined in consideration of the electrophotographic properties of the resultant photoreceptor and economic effects, and is preferably from 5 μm to 50 μm, more preferably from 10 μm to 40 μm, and even more preferably from 20 μm to 30 μm.

The charge generation layer 505 has a function of generating charge carriers. The charge generation layer 505 typically includes a silicon atom, and substantially no carbon atom, and optionally includes a hydrogen atom. Namely, the charge generation layer 505 includes an amorphous-Si:H material, and has the predetermined photosensitive properties, particularly, a combination of charge generating property, and charge transporting property. The thickness of the charge generation layer 505 is determined in consideration of the electrophotographic properties of the resultant photoreceptor and economic effects, and is preferably from 0.5 μm to 15 μm, more preferably from 1 μm to 10 μm, and even more preferably from 1 μm to 5 μm.

The amorphous-silicon based outermost layer 503 is optionally formed on the photosensitive layer 502 to impart a good combination of resistance to moisture and repeated use, electric durability, stability to withstand environmental conditions and durability to the resultant photoreceptor. The thickness of the outermost layer 503 is preferably from 0.01 μm to 3 μm, more preferably from 0.05 μm to 2 μm, and even more preferably from 0.1 μm to 1 μm. When the outermost layer 503 is too thin, the layer tends to easily wear off due to abrasion. In contrast, when the outermost layer is too thick, the electrophotographic properties of the photoreceptor deteriorate because the photoreceptor tends to have a relatively high residual potential after being exposed to imagewise light (i.e., an optical image), resulting in deterioration of image qualities.

The photoreceptor for use in the image forming apparatus of the present invention preferably includes a filler-reinforced outermost layer, and/or a crosslinked charge transport material therein.

Specific examples of the filler to be included in the outermost layer include polymers and copolymers including a unit obtained from vinyl fluoride, vinylidene fluoride, chlorotrifluoroethylene, tetrafluoroethylene, hexafluoropropylene, and perfluoroalkylvinyl ether.

Specific examples of the substrate include cylinders and films of metals (such as aluminum and stainless steel), papers, and plastics.

An undercoat layer (or adhesive layer) having both a barrier function and an adhesive function can be formed on the substrate. Such an undercoat layer is formed to improve the adhesiveness of the photosensitive layer to the substrate and the film forming property of the photosensitive layer to be formed thereon by coating; to protect the substrate; to cover the defects of the substrate; to prevent injection of charges to the photosensitive layer from the substrate; and to electrically cover the photosensitive layer. Specific examples of the material for use in the undercoat layer include polyvinyl alcohol, poly-N-vinyl imidazole, polyethylene oxide, ethyl cellulose, methyl cellulose, ethylene-acrylic acid copolymers, casein, polyamide, nylon copolymers, glue, gelatin, etc. These materials are solved in a proper solvent to prepare a coating liquid, and the coating liquid is coated on the substrate, followed by drying, resulting in formation of the undercoat layer. The thickness of the undercoat layer is preferably from 0.2 μm to 2 μm.

Specific examples of the photosensitive layer includes layered photosensitive layers including a charge generation layer and a charge transport layer, and single-layer photosensitive layers including both a charge generation material and a charge transport material therein.

Specific examples of the charge generation materials include pyrylium, thiopyrylium dyes, phthalocyanine pigments, antoanthrone pigments, dibenzpyrenequinone pigments, pyranthron pigments, trisazo pigments, disazo pigments, azo pigments, indigo pigments, quinacridone pigments, asymmetric quinocyanine, quinocyanine, etc. Specific examples of the charge transport materials include pyrene, N-ethyl carbazole, N-isopropyl carbazole, N-methyl-N-phenylhydrazino-3-methylidene-9-ethyl carbazole, N,N-diphenylhydrazino-3-methylidene-9-ethyl carbazole, N,N-diphenylhydrazino-3-methylidene-10-ethyl phenothiazine, N,N-diphenylhydrazino-3-methylidene-10-ethyl phenoxazine, p-diethylaminobenzaldehyde-N,N-diphenyl hydrazone, triaryl methane compounds such as p-diethylaminobenzaldehyde-2-methylphenyl-phenyl methane, polyarylalkane compounds such as 1,1-bis(4-N,N-diethylamino-2-methylphenyl)heptane and 1,1,2,2-tetrakis(4-N,N-dimethylamino-2-methylphenyl)ethane, triarylamine compounds, etc.

As mentioned above, it is preferable for the photoreceptor to include an outermost layer (protective layer) including a filler such as organic fillers and inorganic fillers to improve the abrasion resistance of the layer. Specific examples of the organic fillers include powders of fluorine-containing resins such as polymers and copolymers including a unit obtained from vinyl fluoride, vinylidene fluoride, chlorotrifluoroethylene, tetrafluoroethylene, hexafluoropropylene, and perfluoroalkylvinyl ether; powders of silicone resins; powders of amorphous carbons; etc. Specific examples of the inorganic fillers include powders of metals such as copper, tin, aluminum, and indium; powders of metal oxides such as tin oxide, zinc oxide, titanium oxide, indium oxide, antimony oxide, bismuth oxide, antimony-doped tin oxide, and tin-doped indium oxide; titanates such as potassium titanate; etc. These fillers can be used alone or in combination. The filler-reinforced outermost layer is typically prepared by a coating method. Specifically, a filler is dispersed in an outermost layer coating liquid using a proper dispersing machine, and the resultant outermost coating layer liquid is coated on the photosensitive layer, followed by drying, resulting in formation of an outermost layer. The average particle diameter of the filler included in the outermost layer is preferably not greater than 0.5 μm, and preferably not greater than 0.2 μm in view of the transparency of the outermost layer. In addition, the outermost layer can include additives such as plasticizers and leveling agents.

Next, the developer for use in developing electrostatic images on the photoreceptor 1 will be explained.

The developer includes a toner, which preferably has a shape factor SF-1 of from 100 to 150.

The shape factor SF-1 represents the roundness of particles and is determined by the following method:

(1) particles of a toner are observed using a scanning electron microscope (S-800, manufactured by Hitachi Ltd.) and a photograph thereof is taken; and (2) toner particles, which are randomly selected from the toner particles in the photograph image, are analyzed using an image analyzer (LUZEX 3 manufactured by Nireco Corp.).

The shape factor SF-1 is defined by the following equation:

$$SF\text{-}1=((MXLNG)^2/AREA)\times(\pi/4)\times 100$$

wherein MXLNG represents the maximum length of a toner particle (illustrated in FIG. 3) in the micrograph; and AREA represents the area of the toner particle.

When the shape factor SF-1 of a toner is 100, which is the minimum value, the toner has a spherical form. As the shape factor SF-1 increases from 100, the shape of the toner is apart from the spherical form, i.e., the shape becomes irregular forms.

When particles of the toner have forms near the spherical form, contact of the toner particles with each other and contact of the toner particles with the photoreceptor are point contact. Therefore, the attraction between the toner particles weakens, thereby increasing the fluidity of the toner. In addition, the attraction between the toner particles and the photoreceptor is weak, and thereby the toner images on the photoreceptor can be transferred on a receiving material at a high transfer rate. When the shape factor SF-1 of the toner is greater than 150, the transfer rate of the toner deteriorates.

Next, the image forming operation will be explained. In this example, a nega-posi developing method, in which the polarity of the toner is the same as that of the electrostatic latent image formed on the photoreceptor and therefore the toner is selectively adhered to a portion having a low potential, is used. In addition, a non-contact charging roller is used as the charger 3.

Figure 4:
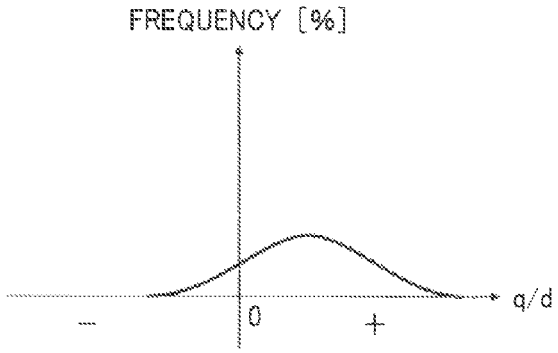
FIG. 4 is a graph illustrating an example of the charge (q/d) distribution curve of toner.

In the following explanation, the q/d distribution (i.e., charge distribution) of toner, an example of which is illustrated in FIG. 4, is determined using an E SPART ANALYZER manufactured by Hosokawa Micron Corp. Referring to FIG. 4, the property q/d (i.e., ratio of charge quantity (q) in units of fC to diameter (d) in units of μm) of a toner particle is plotted on the X-axis, and the percentage (i.e., frequency) of toner particles having such a q/d property is plotted on the Y-axis. In this regard, the number of residual toner particles used for determining the q/d distribution is 500.

When a print button (not shown) in an operation section of the image forming apparatus is pushed by an operator, respective voltages (or currents) are applied to the noncontact charging roller 3, developing roller 8, transfer roller 11, toner polarity controlling blade 22, cleaning brush 23, collection roller 24, and discharging lamp 36 at predetermined timings. In addition, at the same time, the photoreceptor 1, charging roller 3, transferring device 15, developing roller 8, first and second developing screws 9 and 10, cleaning brush 23, collection roller 24 and toner discharging screw 19 are rotated in the respective directions. In this case, the rotation speed of the photoreceptor 1, cleaning brush 23, and collection roller 24 is 200 mm/s.

The surface of the photoreceptor 1 is negatively charged by the noncontact charging roller 3 so as to have a potential of −700V. Next, the laser beam 4 imagewise irradiates the charged photoreceptor 1 so that the light-irradiated portion (i.e., (solid) image portion) of the resultant electrostatic image has a potential of −120V. The electrostatic image is developed with a magnetic brush, which is formed on the developing roller 8 and which includes the toner therein, while applying a developing bias of −450V, thereby forming a toner image on the photoreceptor 1. In this regard, the toner adheres to the light-irradiated portion having a potential of −120V. The toner image thus formed on the photoreceptor 1 is transferred to a receiving material sheet, which is timely fed by a registration roller (not shown) so that the toner image is transferred on a predetermined position of the sheet. In this regard, a transfer bias of 20 μA is applied. The receiving material sheet bearing the toner image thereon is then separated from the photoreceptor, and further the toner image is fixed by a fixing device (not shown). The receiving material sheet bearing the fixed toner image thereon (i.e., a copy image) is then discharged from the image forming apparatus.

After the toner image on the photoreceptor 1 is transferred to the receiving material sheet at the transfer portion (transfer nip) by the transfer roller 11, a part of the toner image (i.e., residual toner particles) remains on the photoreceptor without being transferred. Such residual toner particles typically have a charge distribution as illustrated in FIG. 4, i.e., toner particles with a positive polarity and toner particles with a negative polarity are mixed. Due to rotation of the photoreceptor 1, the residual toner particles are fed toward the toner polarity controlling blade 22. In this example, the toner polarity controlling blade 22 is arranged so as to counter the photoreceptor 1 as illustrated in FIG. 1. However, the toner polarity controlling blade 22 may be arranged so as to trail the photoreceptor 1.

It is preferable for the toner polarity controlling blade 22 to be made of an elastic material such as polyurethane rubbers and to be electroconductive. The thickness thereof is preferably from 1,000 μm to 4,000 μm, and more preferably from 2,000 μm to 3,000 μm. When the toner polarity controlling blade 22 is too thin, the entire of the tip of the blade cannot be well contacted with the photoreceptor 1 due to waving of the blade. In contrast, when the blade is too thick, vibration cannot be well transmitted to the tip of the blade from a vibrating member because the blade absorbs the vibration transmitted from a vibration member, resulting in deterioration of controlling the polarity of the residual toner particles.

The toner polarity controlling blade 22 preferably has a hardness (JIS A hardness) of from 40 to 85, and a resistivity of from $2\times10^5$ Ω·cm to $5\times10^9$ Ω·cm. In this example, the toner polarity controlling blade 22 has the following properties:

Thickness: 2 mm

Length of free portion (i.e., the portion of the blade not supported by the holder): 7 mm JIS A hardness: 60 to 80

Repulsive elastic coefficient: 30%

Contact angle: 20°

Contact pressure: 20 gf/cm (0.196 N/cm)

Penetration depth of blade to photoreceptor: 0.5 mm

Resistivity: $1\times10^8$ Ω·cm

Angle of edge of blade contacting photoreceptor: 90°

Next, the toner polarity controlling blade having a cover layer thereon for use in the present invention will be explained.

Figure 5A:
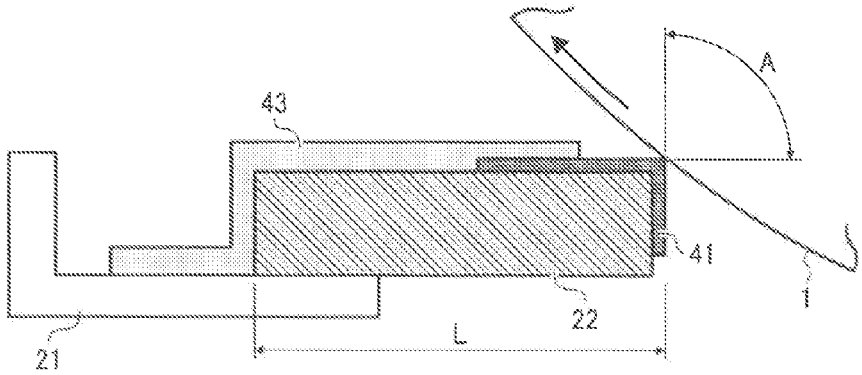
FIGS. 5A and 5B are schematic views illustrating examples of the polarity controlling device according to an embodiment of the present invention.
Figure 5B:
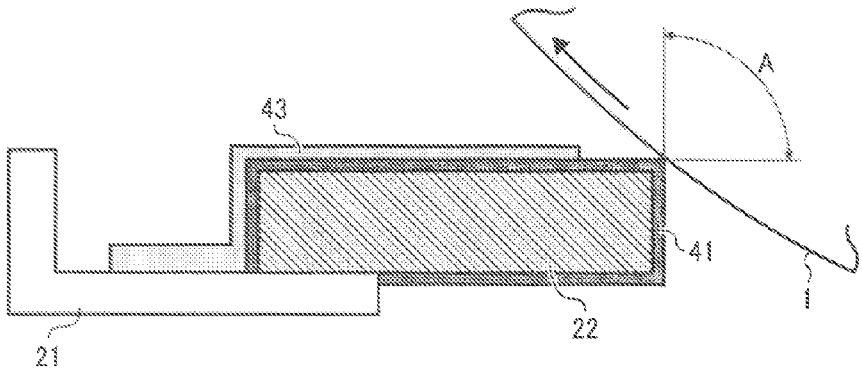

As illustrated in FIG. 5A, at least the surface portion of the toner polarity controlling blade 22, which contacts the photoreceptor 1, has a cover layer 41 including a resin. Alternatively, as illustrated in FIG. 5B, the entire surface of the toner polarity controlling blade 22 may have the cover layer 41. Specific examples of the resin included in the cover layer include polymers and copolymers including a unit obtained from a compound such as trimethylolpropane tri(meth)acrylate, neopentylglycol di(meth)acrylate, pentaerythritol tri(meth)acrylate, pentaerythritol tetra(meth)acrylate, trimethylolethane tri(meth)acrylate, tetramethylolmethane tetra(meth)acrylate, oligoester (meth)acrylate, etc. Specific examples of the electroconductive materials to be included in the cover layer include alkali metal salts (e.g., lithium peroxide) quaternary ammonium salts (tetrabutyl ammoniums), ionic electroconductive agents (electroconductive polymers), carbon blacks (e.g., KETJEN BLACK and acetylene black), etc. The cover layer is preferably thin to an extent so as not to deteriorate the dimensional precision and properties of the blade, and the thickness thereof is preferably from 2 μm to 10 μm in consideration of the life thereof and the above-mentioned factors.

The cover layer preferably has a high hardness and a low friction coefficient. In order to impart a high hardness to the cover layer, the resin included in the cover layer preferably has a pencil hardness of from B to 6H. In order to impart a low friction coefficient to the cover layer, the resin included in the cover layer preferably has a contact angle of from 85° to 140° against pure water.

As illustrated in FIGS. 5A and 5B, the toner polarity controlling blade 22 is in the form of plate, and the length of one side of the blade parallel to the axis of the photoreceptor 1 is longer than the length (i.e., L in FIG. 5A) of the other side of the blade. The blade 22 is adhered to the blade holder 21. In addition, the blade 22 is electrically connected with the holder 21 using an electroconductive tape 43 (shield tape, electroconductive cloth adhesive tape No. 1821 from Teraoka Seisakusho Co., Ltd.). In this regard, other electroconductive tapes and adhesives can also be used as long as the blade can be electrically connected with the holder thereby.

If the cover layer 41 is electrically connected with the holder 21 using the electroconductive tape 43 as illustrated in FIGS. 5A and 5B, the toner polarity controlling blade 22 may be insulating. In this case, it is preferable for the insulating blade to have the above-mentioned properties (such as hardness and elasticity) that the electroconductive blade preferably have.

Figure 5C:
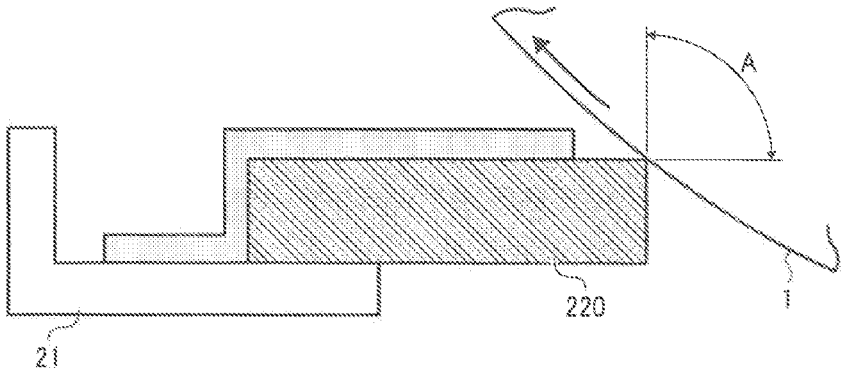
FIG. 5C BACKGROUND ART
FIG. 5C is a schematic view illustrating a background polarity controlling device using a blade whose surface is not coated.

FIG. 5C illustrates a background polarity controlling blade having no cover layer thereon.

As illustrated in FIGS. 5A and 5B, the contact edge of the toner polarity controlling blade 22, which contacts the photoreceptor 1, has an angle (A) of 90°.

The resin included in the cover layer 41 preferably has a good toner releasability. Specific examples of the resin include the polymers and copolymers mentioned above.

Next, the cleaning operation will be explained.

Figure 20A:
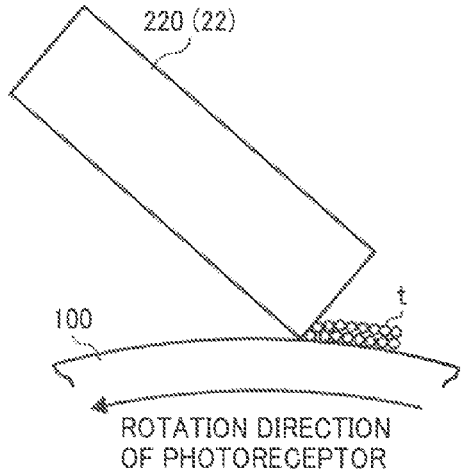
FIGS. 20A-20C illustrates change of the state of a blade contacted with a photoreceptor in a background polarity controlling device.
Figure 20B:
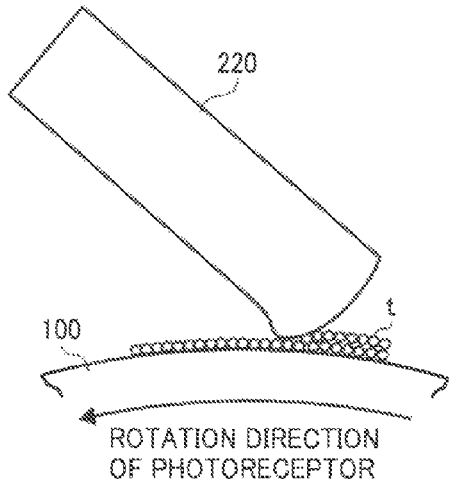
FIG. 20B BACKGROUND ART
Figure 20C:
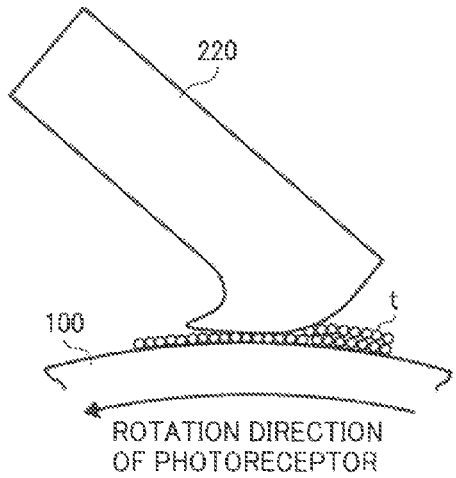
FIG. 20C BACKGROUND ART

As illustrated in FIG. 20A, almost all the residual toner particles (t) on a photoreceptor 100 are scraped off by a conventional toner polarity controlling blade 220. However, when the blade 220 causes sticking and slipping in the repeated use of the blade, a part of the residual toner particles passes through the nip between the blade and the photoreceptor 100 as illustrated in FIGS. 20B and 20C.

By way of comparison, the operation of the cleaner of the image forming apparatus of the present invention will be explained by reference to FIG. 1. Specifically, since a voltage having the same polarity (negative polarity) as that of the toner is applied to the blade 22 by the power source 29, the toner particles passing through the nip (passing along the blade) are charged to have the desired polarity (negative polarity in this example) that the toner should have. For example, the voltage applied to the blade is such that the potential difference between the surface potential of the photoreceptor 1 and the applied voltage is −1000V.

The toner particles (t) thus (negatively) charged are then fed toward the cleaning brush 23 due to rotation of the photoreceptor 1. Since a voltage (e.g., +250V) having a polarity (positive polarity) opposite to that of the charged toner is applied to the brush 23 by the power sources 30 and 34, the negatively charged toner particles are electrostatically adhered to the brush 23. The toner particles (t) electrostatically adhered to the brush 23 are then transferred to the collection roller 24 because a (positive) voltage (e.g., +650V) higher than the voltage (+250V) applied to the brush 23 is applied to the collection roller 24. The toner particles on the collection roller 24 are scraped off by the collection roller cleaning blade 31. The toner discharging screw 19 discharges the toner particles from the image forming apparatus or returns the collected toner particles to the developing device 7 to be re-used for developing.

Figure 6:
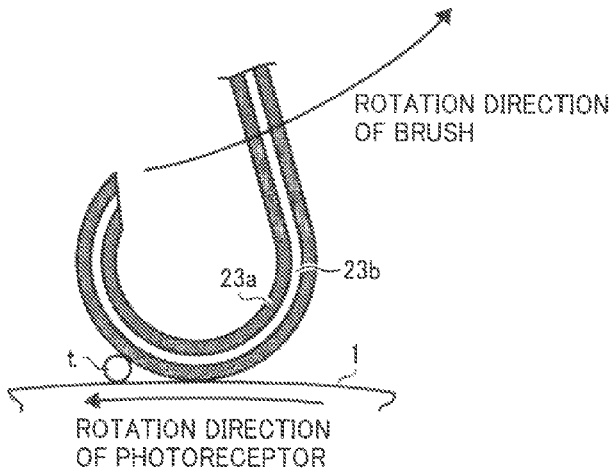
FIG. 6 is an enlarged view of the tip portion of a fiber of a cleaning brush of the cleaner according to an embodiment of the present invention.

Next, the cleaning brush 23 will be explained in detail. As illustrated in FIG. 6, fibers of the brush 23 have a capsule structure and includes a cylindrical shell 23*a*, which is insulating and has a hollow 23*b* filled with an electroconductive agent. The fibers curl in the direction opposite to the rotation direction of the brush 23 as illustrated in FIG. 6. Since the fibers of the brush 23 are thus curled, the chance that the tip portions of the fibers contact the toner particles (t) can be reduced, and thereby the amount of charges injected into the toner particles can be reduced.

In addition, in order to reduce the amount of charges injected into the toner particles between the brush 23 and the collection roller 24, the collection roller 24 has a structure such that a metal shaft is covered with a tube made of a polyvinylidene fluoride (PVDF), and an insulating layer is formed on the tube as an outermost layer.

Further, as illustrated in FIG. 1, the charge supplying member 33 made of a metal is arranged so as to be contacted with the surface of the brush 23, and in addition a voltage is applied to the shaft of the brush 23 by the power supply 34.

The reason why the charge applying member 33 is provided is as follows. Specifically, when the toner particles (t) are transferred to the collection roller 24 from the brush 23, the potential of the brush decreases because the surface of the fibers of the brush is insulating. In order to prevent the potential of the brush from decreasing, charges are supplied to the brush by the charge supplying member 33.

The reason why the potential of the brush 23 decreases is not yet determined, but it is considered that reception and delivery of the toner particles on the brush affects the potential decrease. Specifically, the reason is considered as follows. When the toner particles adhered to the fibers of the brush 23 and having a charge are transferred to the collection roller 24, discharge is caused between the fibers and the toner particles, thereby imparting a negative charge to the shell 23*a* of the fibers. Alternatively, when the toner particles, which have a negative charge, are adhered to the fibers of the brush, a negative charge is imparted to the fibers, and the negative charge remains on the fibers even after transferring the toner particles to the collection roller 24.

When the potential of the surface of the brush decreases, the toner removing property of the brush deteriorates. In order to prevent the potential of the brush from decreasing, the charge supplying member 33 made of a metal, to which the same voltage as that supplied to the brush 23, is provided so as to contact the surface of the brush.

Similarly to the above-mentioned case of the brush 23, when the toner particles adhered to the surface of the collection roller 24 is scraped off by the collection roller cleaning blade 31, the potential of the collection roller 24 decreases. The mechanism thereof is not yet determined, but is considered as follows. Specifically, when the toner particles adhered to the collection roller 24 and having a charge are scraped off by the collection roller cleaning blade 31, discharge is caused, thereby imparting a negative charge to the outermost layer of the collection roller 24. Therefore, negative charges remain on the collection roller 24. In order to prevent the potential of the collection roller 24 from decreasing, a voltage higher than the voltage applied to the shaft of the collection roller 24 is applied to the collection roller by the power source 32 via the collection roller cleaning blade 31, which is electroconductive.

Next, change of the charge distribution of toner particles passing through the nip between the photoreceptor 1 and the toner polarity controlling blade 22 will be explained.

Figure 7:
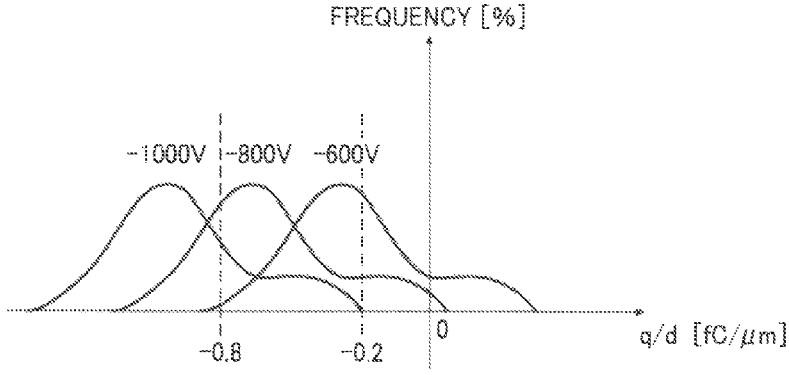
FIG. 7 illustrates other examples of the charge (q/d) distribution curve of toner charged by a blade while changing the voltage applied to the blade.

The toner particles passing through the nip receives charges due to friction charging, charge injection and discharging. When the voltage applied to the blade 22 is changed so as to be −600V, −800V and −1000V, the charge (q/d) distribution of the toner particles shifts to the negative side as illustrated in FIG. 7.

Even in this example of the image forming apparatus of the present invention, the toner polarity controlling blade 22 causes sticking and slipping in the repeated use of the blade and the contact state of the blade changes similarly to the case of conventional blades illustrated in FIGS. 20B and 20C. In this case, a part of the residual toner particles passes through the nip between the blade and the photoreceptor. Since a voltage (negative voltage in this case) is applied to the toner polarity controlling blade 22, a current flows in the toner particles when the toner particles are sandwiched by the blade and the photoreceptor, and thereby the toner particles are charged so as to have the same polarity (negative polarity in this example) as that of the applied voltage.

Charging of the toner particles in this case is considered to be caused by charge injection. When the difference between the voltage applied to the toner polarity controlling blade 22 and the surface potential of the photoreceptor 1 is higher than a discharge starting voltage, discharge occurs at the entrance and exit portions (each having a wedge form as illustrated as Z in FIG. 11) of the nip between the blade and the photoreceptor, thereby charging the toner particles so as to have the same polarity (negative polarity in this example) as that of the applied voltage. In general, the surface of the toner polarity controlling blade 22 at the wedge-form entrance portion of the nip is soiled with toner particles because the surface scrapes off toner particles. Therefore, discharge is mainly caused at the wedge-form exit portion of the nip.

The thus (negatively) charged toner particles are then electrostatically attracted to the cleaning brush 23, to which a voltage having the opposite polarity is applied. In this regard, it is considered to be preferable that the q/d distribution curve of the charged toner particles falls in a certain range.

In this regard, when the cleaning brush 23 contacts the photoreceptor 1 and the cleaning brush contacts the collection roller 24, a certain level of charge injection is caused to the toner particles although the level depends on the voltages applied to the cleaning brush and the collection roller. In consideration of the charge injection, the q/d distribution curve of the charged toner particles falls in a certain range slightly apart from the point of 0 fC/μm. Specifically, the lower end of the q/d distribution curve (i.e., the right end of the q/d distribution curve in FIG. 7) is preferably not less than −0.2 fC/μm. In this case, the toner particles can maintain the desired (negative) polarity even when the above-mentioned charge injection is caused. With respect to the higher end of the q/d distribution curve, when the toner particles have too high charges, the attraction between the toner particles and the photoreceptor increases, and thereby it becomes difficult for the cleaning brush 23 to electrostatically remove the toner particles from the photoreceptor. Therefore, the higher end of the q/d distribution (i.e., the left end of the q/d distribution curve in FIG. 7) is preferably not higher than −0.8 fC/μm. Namely, the q/d distribution curve of the charged residual toner particles preferably is in a range of from −0.2 fC/μm to −0.8 fC/μm to well remove the residual toner particles from the photoreceptor.

Next, the polarity controlling performance of the toner polarity controlling blade having a cover layer including an electroconductive material dispersed in a resin will be explained.

As mentioned above, by applying a voltage to the toner polarity controlling blade 22 to flow a current in the toner or to cause discharge at the entrance and exit portions of the nip between the blade and the photoreceptor, the polarity of the residual toner is controlled so as to have the desired polarity. Specifically, when a negative toner is used, residual toner particles having positive charges or no charge are charged to have negative charges, and residual toner particles having negative charges are charged to have a larger amount of negative charges.

Therefore, it is preferable that the gaps at the entrance and exit portions of the nip are stably maintained so as to be narrow and the variation of the resistivity of the blade 22 is as small as possible in order to stably impart a predetermined amount of charges to the toner particles. In this case, the charged toner particles have a sharp q/d distribution curve.

Figure 21:
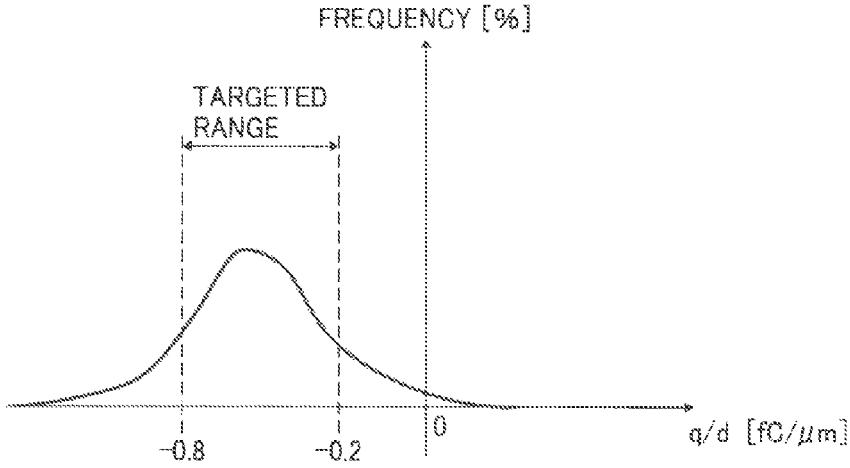
FIG. 21 BACKGROUND ART
FIG. 21 is a graph illustrating the charge (q/d) distribution of toner charged by the background polarity controlling device illustrated in FIG. 20.
Figure 22A:
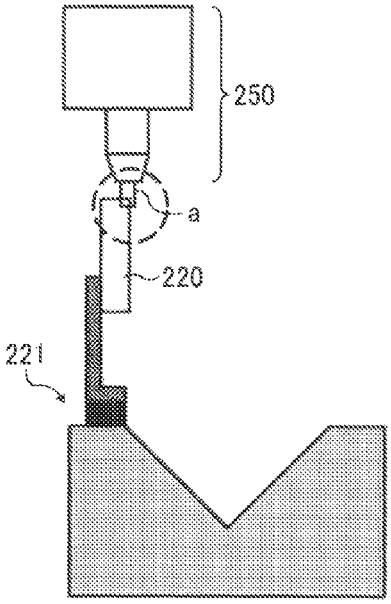
FIGS. 22A and 22B illustrate an instrument (laser microscope) for use in determining the profile of the edge portion of an abraded blade.
Figure 22B:
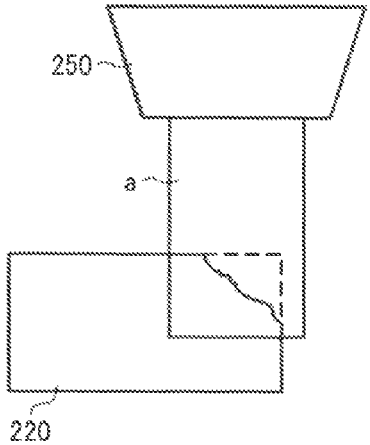
Figure 24A:
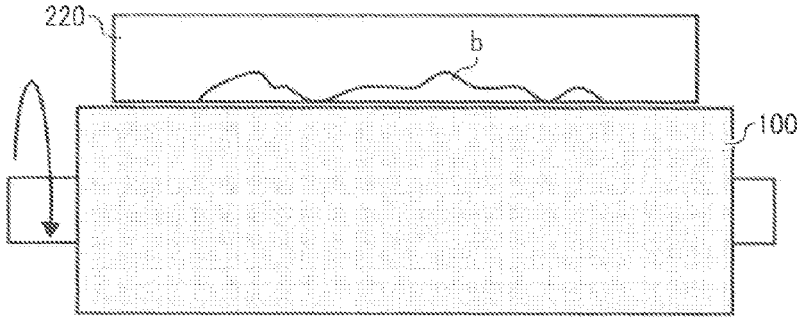
FIGS. 24A and 24B illustrate how toner particles pass through abraded portions of a blade.
Figure 24B:
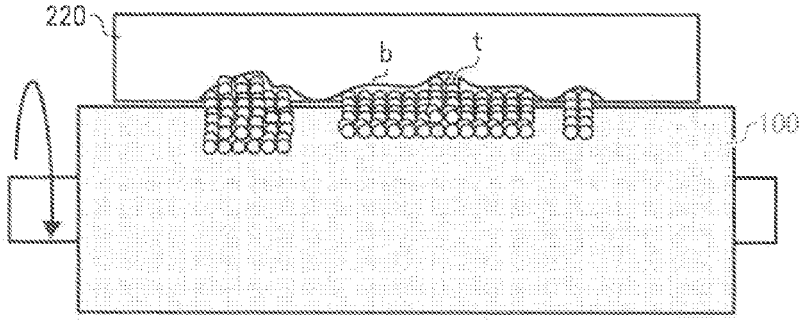
Figure 25:
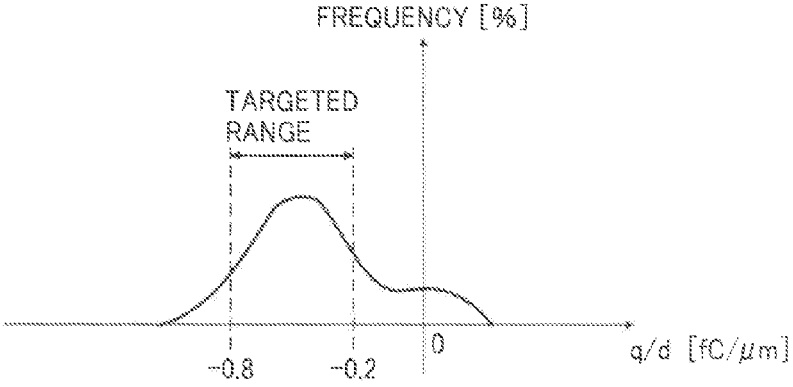
FIG. 25 BACKGROUND ART
FIG. 25 is a graph illustrating the charge (q/d) distribution of toner charged by a blade of a conventional polarity controlling device, wherein the edge portion of the blade is abraded.

Conventional toner polarity controlling blades typically have a high friction coefficient, and therefore often cause sticking and slipping as illustrated in FIGS. 20B and 20C, resulting in change of the width of the nip between the blade 220 and the photoreceptor 100. Accordingly, the amount of charges injected to the toner particles changes, thereby causing a problem in that the q/d distribution curve of the charged toner particles is too broad to fall in the desired range of from −0.2 fC/μm to −0.8 fC/μm as illustrated in FIG. 21 and/or a problem in that the edge portion of the blade is seriously abraded as illustrated in FIGS. 22B and 24A, and thereby part of the toner particles is not charged as illustrated in FIG. 24B, resulting in broadening of the q/d distribution curve as illustrated in FIG. 25.

Figure 26A:
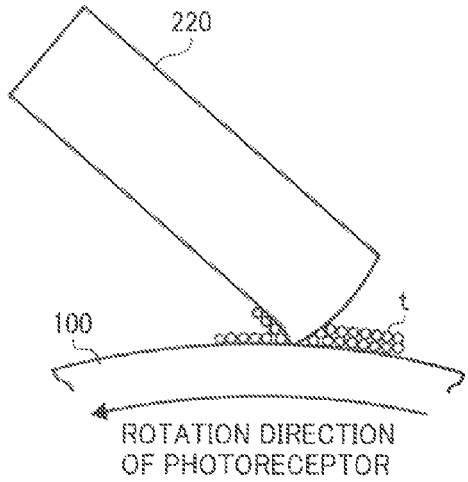
FIG. 26A BACKGROUND ART
FIGS. 26A-26C illustrate the behavior of toner particles in a background polarity controlling device.
Figure 26B:
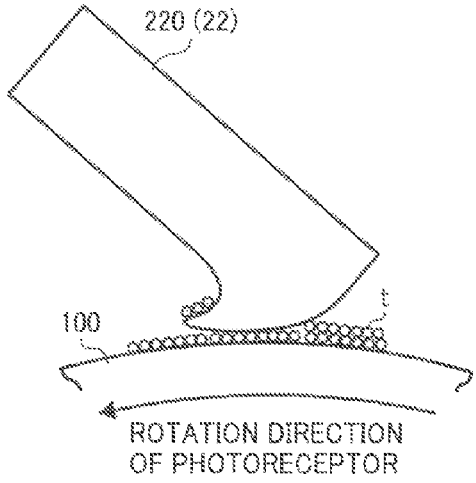
FIG. 26B BACKGROUND ART

In addition, such conventional toner polarity controlling blades cause another problem. Specifically, as illustrated in FIG. 26A, some of toner particles having a polarity opposite to that of the voltage applied to the blade are attracted to the toner-exit-side of the blade. Since conventional toner polarity controlling blades typically have a poor toner releasability, the toner particles adhered to the blade are not removed therefrom even when the blade repeats sticking and slipping, and thereby discharge at the exit side of the blade becomes unstable, resulting in broadening of the q/d distribution curve as illustrated in FIG. 25.

In addition, urethane resins are typically used for conventional toner polarity controlling blades. Since electroconductive materials cannot be well dispersed in urethane resins, the resistivity of such conventional toner polarity controlling blades largely varies, resulting in broadening of the q/d distribution curve to such a degree as not to fall in the targeted range of from −0.2 fC/μm to −0.8 fC/μm as illustrated in FIG. 21. Therefore, the residual toner particles cannot be well removed from the photoreceptor by a cleaning brush. When resin materials in which electroconductive materials can be well dispersed are used for the toner polarity controlling blade, another problem in that the physical properties of the blade deteriorate, and thereby the blade cannot be practically used occurs.

In the present invention, by using a blade coated with a resin layer (hereinafter referred to as a cover layer) including an electroconductive material dispersed in a resin as the toner polarity controlling blade 22, the polarity controlling performance of the blade can be enhanced while maintaining the good scraping function of the blade.

Specifically, by forming the cover layer 41 on the surface of a blade, the friction coefficient of the blade can be decreased, and thereby sticking and slipping are not easily caused. Namely, the state of the blade contacting the photoreceptor as illustrated in FIG. 20A can be stably maintained. Therefore, the toner particles charged by this blade tend to have a sharp q/d distribution curve as illustrated by a heavy line in FIG. 8.

Figure 9:
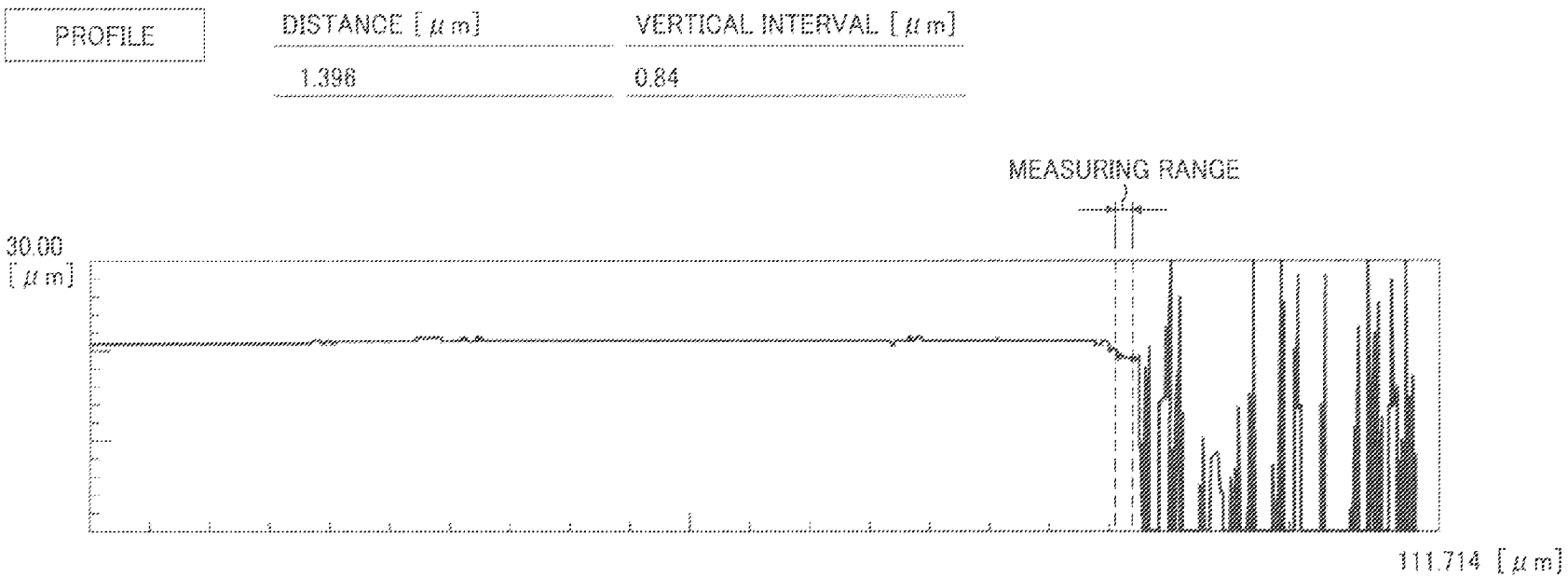
FIG. 9 illustrates the profile of a resin-coated blade having a rectangular edge after the blade is used for cleaning.
Figure 23:
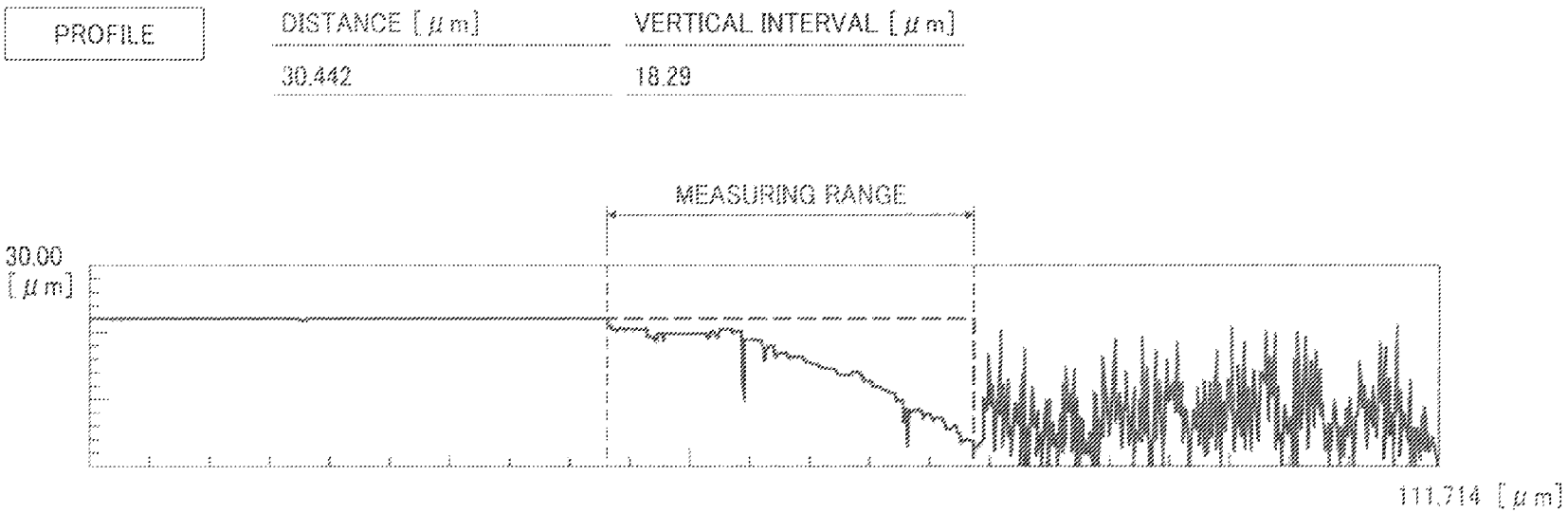
FIG. 23 BACKGROUND ART
FIG. 23 illustrates the profile of the edge portion of a background blade, which is not coated with a resin and which has a right angle, after the blade is used for cleaning.

In addition, by forming the cover layer 41, a high hardness can be imparted to the blade 22. The blades having the cover layer 41 illustrated in FIGS. 5A and 5B have such an abrasion property as illustrated in FIG. 9. In contrast, the blade having no cover layer illustrated in FIG. 5C has such an abrasion property as illustrated in FIG. 23. It is clear from FIGS. 9 and 23 that the abrasion loss of the blades illustrated in FIGS. 5A and 5B is much smaller than that of the blade illustrated in FIG. 5C even when the blades are used for the same time.

Thus, the toner polarity controlling blades 22 illustrated in FIGS. 5A and 5B, which have the cover layer on the surface thereof, hardly cause the problem in that toner particles pass through the nip between the blades and the photoreceptor without being charged, resulting in broadening of the q/d distribution curve of the charged toner particles. Namely, the toner polarity controlling blades can charge the residual toner particles so as to have a narrow q/d distribution curve. In addition, since the toner polarity controlling blades 22 illustrated in FIGS. 5A and 5B have good toner releasability, the toner particles adhered to the exit side of the blades can be easily released therefrom by vibration of the blades due to sticking and slipping of the blades and the like. Therefore, a narrow wedge-form gap can be formed at the exit side of the blades, and thereby discharge can be stably caused in the gap. Therefore, the charged toner particles have a narrow q/d distribution curve.

Figure 26C:
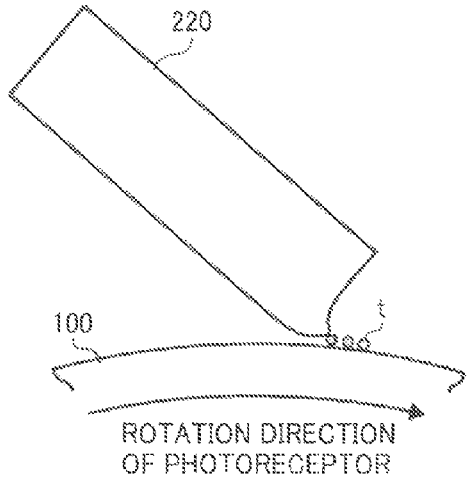
FIG. 26C BACKGROUND ART

In this regard, it is possible that after completion of one image forming job, the photoreceptor is reversely rotated as illustrated in FIG. 26C so that the toner particles can be easily released from the blade. In this case, it is preferable that the voltage applied to the blade is not applied so that electrostatic force is not applied to the toner particles.

As mentioned above, acrylic resins can be preferably used for the cover layer 41. Electroconductive agents can be well dispersed in such acrylic resins as mentioned above, and thereby the variation of resistivity of the blade can be reduced. Therefore, the toner particles charged by the blade have a narrow q/d distribution curve. In addition, acrylic resins tend to impart a negative charge to toner. Therefore, the blade coated with the cover layer 41 including an acrylic resin can stably impart a negative charge to toner particles. Accordingly, the toner particles charged by the blade have such a narrow q/d distribution curve as illustrated by a heavy line in FIG. 10.

Thus, the charged toner particles have a narrow q/d distribution curve almost falling in the desired range, and thereby the charged toner particles can be efficiently removed from the photoreceptor 1 by the cleaning brush 23 located on the downstream side from the blade 22. In addition, forming the cover layer 41 on the blade prevents occurrence of a bleeding problem in that additives such as vulcanizing agents included in the blade 22 bleed from the surface of the blade, and soil the photoreceptor, resulting in formation of abnormal images such as white spot images and black streak images.

In this example of the cleaner 16 for use in the image forming apparatus of the present invention, the details of the components of the cleaner are as follows.

(1) Material of cleaning brush 23: Electroconductive polyester having fibers with a length of 5 mm
(2) Penetration depth of cleaning brush into photoreceptor: 1 mm
(i.e., the brush is curved on the photoreceptor by a length of 1 mm)
(3) Linear speed of cleaning brush: 200 mm/s (same as that of photoreceptor)
(4) Voltage applied to charge supplying member 33: +250V
(5) Voltage applied to shaft of cleaning brush: +250V
(6) Resistivity of fibers of cleaning brush: $10^8$ Ω·cm
(7) Density of fibers of cleaning brush: 100,000 pieces/$in^2$
(Fibers are curled in the direction opposite to the rotation direction of the brush as illustrated in FIG. 6)
(8) Collection roller 24: roller having diameter of 10 mm and including a SUS shaft, a PVDF tube with a thickness of 100 μm located on the shaft, and an insulating TV coat with a thickness of 5 μm located on the tube
(9) Linear speed of collection roller: 200 mm/s
(10) Voltage applied to collection roller: +650V
(11) Resistivity of collection roller cleaning blade 31: $10^{6-8}$ Ω·cm
(12) Contact angle of collection roller cleaning blade 31: 20°
(13) Penetration depth of blade 31 into collection roller: 1 mm
(i.e., the blade is curved on the collection roller by a length of 1 mm)
(14) Thickness of blade 31: 2 mm
(15) Free length of blade 31: 7 mm
(16) JIS A hardness of blade 31: 60-80
(17) Repulsive elastic coefficient of blade: 30%
(18) Voltage applied to blade 31: +1450V The voltages applied to the toner polarity controlling blade 22, charge supplying member 33, cleaning brush 23, collection roller 24, and cleaning blade 31 may have a polarity opposite to those mentioned above. For example, when a positive voltage is applied to the toner polarity controlling blade 22, residual toner particles (which have negative charges) are attracted by the blade (resulting in removal of the toner particles), but some of the residual toner particles pass through the blade. These toner particles, which have been charged to have positive charges, are collected by the cleaning brush 23, to which a negative voltage is applied.

Toner particles on the collection roller 24 are mechanically removed by the collection roller cleaning blade 31. The mechanism of the mechanical cleaning operation is as follows. Since toner particles adhered to the cleaning brush 23 are transferred onto the collection roller 24 due to the potential difference therebetween, any materials can be used for the collection roller 24. Therefore, by decreasing the friction coefficient of the surface of the collection roller 24, for example, by forming a layer having a low friction coefficient on the roller or by covering the roller with a tube having a low friction coefficient, toner particles thereon can be easily removed. Specifically, methods using a fluorine-containing coating liquid or a PVDF or PFA tube can be used. Since a voltage is applied to the cleaning blade 31, it is preferable to use an electroconductive tape (such as tape 43 illustrated in FIGS. 5A and 5*b*) for the cleaning blade 31 similarly to the case of toner polarity controlling blade 22.

Example 2

In the image forming apparatus of Example 1, only the thickness of the toner polarity controlling blade 22 is changed from 2 mm to 2.4 mm (the blade 22 has the cover layer 41 thereon). As a result, the charged residual toner particles have a relatively sharp q/d distribution curve (as illustrated by the heavy line in FIG. 10) compared to the q/d distribution curve of a toner polarity controlling blade with no cover layer (as illustrated by the thin line in FIG. 10). Therefore, the residual toner particles can be efficiently removed from the photoreceptor 1 by the cleaning brush 23.

Example 3

In the image forming apparatus of Example 1, only the thickness of the toner polarity controlling blade 22 is changed from 2 mm to 2.8 mm (the blade 22 has the cover layer 41 thereon). As a result, the charged residual toner particles have a relatively sharp q/d distribution curve (as illustrated by the heavy line in FIG. 10) compared to the q/d distribution curve of a toner polarity controlling blade with no cover layer (as illustrated by the thin line in FIG. 10). Therefore, the residual toner particles can be efficiently removed from the photoreceptor 1 by the cleaning brush 23.

Example 4

In the image forming apparatus of Example 1, the thickness of the toner polarity controlling blade 22 is changed from 2 mm to 2.4 mm (the blade 22 has the cover layer 41 thereon), and the angle (i.e., angle A in FIG. 5A) of the edge of the blade 22 contacting the photoreceptor 1 is changed from 90° to 120°. As a result, the charged residual toner particles have a relatively sharp q/d distribution curve (as illustrated by the heavy line in FIG. 10) compared to the q/d distribution curve of a toner polarity controlling blade with no cover layer (as illustrated by the thin line in FIG. 10). Therefore, the residual toner particles can be efficiently removed from the photoreceptor 1 by the cleaning brush 23.

Example 5

In the image forming apparatus of Example 1, the thickness of the toner polarity controlling blade 22 is changed from 2 mm to 2.8 mm (the blade 22 has the cover layer 41 thereon), and the angle (i.e., angle A in FIG. 5A) of the edge of the blade 22 contacting the photoreceptor 1 is changed from 90° to 120°. As a result, the charged residual toner particles have a relatively sharp q/d distribution curve (as illustrated by the heavy line in FIG. 10) compared to the q/d distribution curve of a toner polarity controlling blade with no cover layer (as illustrated by the thin line in FIG. 10). Therefore, the residual toner particles can be efficiently removed from the photoreceptor 1 by the cleaning brush 23.

Example 6

In the image forming apparatus of Example 1, a process cartridge including, as a unit, the photoreceptor 1, and one or more devices selected from the charger, developing device and cleaner can be used. The process cartridge can be detachably attached to the image forming apparatus. In this example, a process cartridge including the photoreceptor 1, and the cleaner 16 used for Example 1 of the image forming apparatus is used. Similarly to Example 1 of the image forming apparatus, good cleaning effects can be produced in Example 6.

Comparative Example 1

Figure 11A:
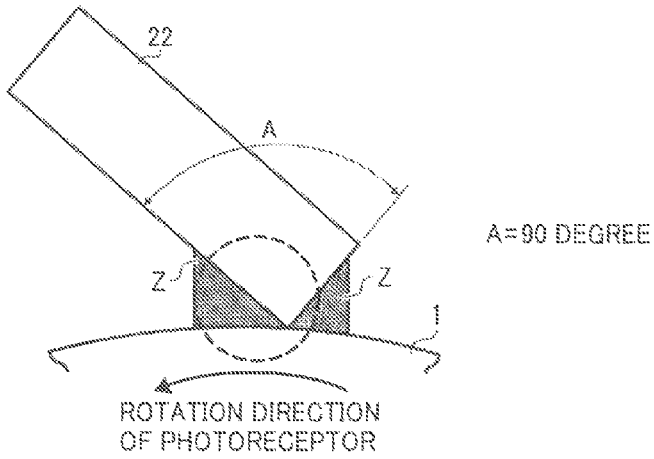
FIGS. 11A and 11B are schematic views illustrating a blade of the polarity controlling device of the present invention, which has a contact edge having a right angle.
Figure 11B:
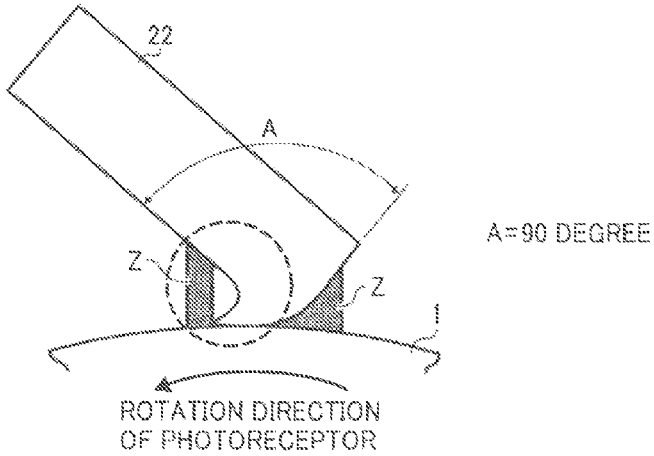
Figure 12A:
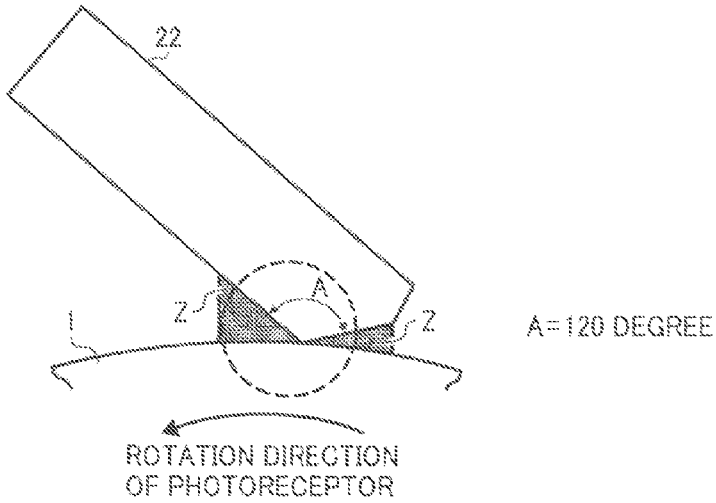
FIGS. 12A and 12B are schematic views illustrating a blade of the polarity controlling device of the present invention, which has a contact edge having an obtuse angle.
Figure 12B:
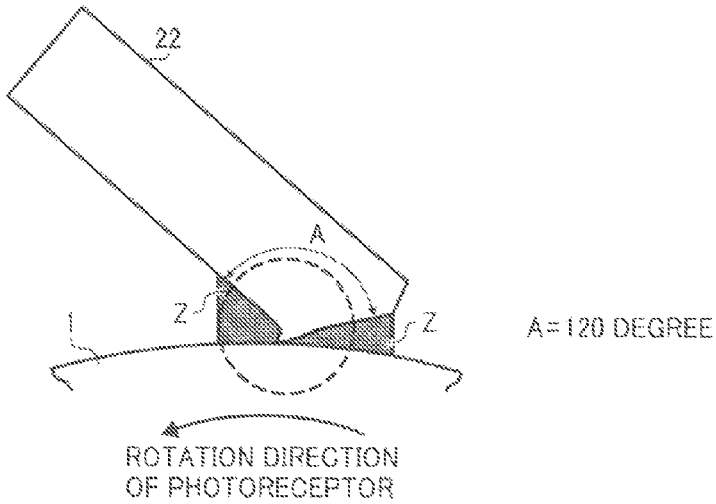

In this comparative example, the toner polarity controlling blade 22 has no resins layer thereon. The angle (A) of the contact edge of the blade 22 contacting the photoreceptor 1 is an obtuse angle as illustrated in FIGS. 12A and 12B. Specifically, the angle (A) of the contact edge of the blade 22 is greater than 90° and not greater than 140°. In this case, the blade 22 can be stably contacted with the photoreceptor 1, and thereby residual toner particles can be charged more stably than in a case of using such a blade having a contact edge of 90° as illustrated in FIGS. 11A and 11B. Namely, the life of the photoreceptor 1 is longer and the image qualities are better than in the case of using a blade having a contact edge of 90°.

In FIGS. 11 and 12, character Z represents a discharge occurring region, in which discharge occurs between the surface of the blade 22 and the surface of the photoreceptor 1. Whether or not discharge occurs depends on the voltage applied to the blade and the distance between the surface of the blade and the surface of the photoreceptor. Therefore, when the applied voltage is constant, discharge does not occur if the distance between the surface of the blade and the surface of the photoreceptor is greater than a certain distance. It is clear from FIGS. 11 and 12 that the discharge occurring region formed by the blade having an obtuse edge (illustrated in FIG. 12) is wider than that formed by the blade having a right-angle edge (illustrated in FIG. 11). Therefore, it is advantageous to use a blade having an obtuse edge.

In this comparative example, the toner polarity controlling blade 22 has the following properties:

Cover layer: No cover layer

Thickness: 2.4 mm

Length of free portion (i.e., the portion of the blade not supported by the holder): 7 mm JIS A hardness: 60-80

Repulsive elastic coefficient: 30%

Angle of edge of blade contacting photoreceptor: 120°

Contact angle: 20°

Contact pressure: 20 gf/cm (0.196 N/cm)

Penetration depth of blade to photoreceptor: 0.5 mm (i.e., the blade is curved on the photoreceptor by a length of 0.5 mm)

Resistivity: $1\times10^{8}$ Ω·cm

Similarly to the toner polarity controlling blade 22 used for Example 1, the blade 22 is electrically connected with the holder 21 using the electroconductive tape 43 (shield tape, electroconductive cloth adhesive tape No. 1821 from Teraoka Seisakusho Co., Ltd.). In this regard, other electroconductive tapes and adhesives can also be used as long as the blade can be electrically connected with the holder thereby.

The toner polarity controlling performance of the blade having an obtuse edge will be explained.

Figure 3:
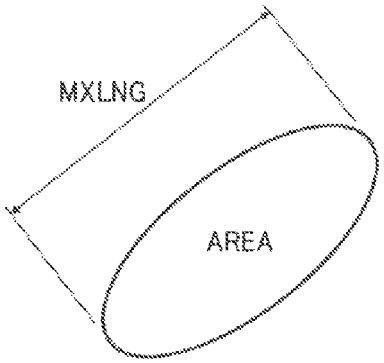
FIG. 3 is a schematic view for explaining how the shape factor SF-1 of a particle is determined.

The blade having a right angle edge as illustrated in FIGS. 3 and 11 often causes sticking and slipping as illustrated in FIG. 11B. When the sticking and slipping are repeated, the nip width of the blade (indicated by a dotted circle in FIG. 11B) changes, resulting in change of charges injected to the toner particles, and charges supplied to the toner particles due to discharge occurring in the discharge occurring region (Z). Therefore, the resultant charged toner particles have such a broad q/d distribution curve as illustrated in FIG. 25. In addition, due to repetition of sticking and slipping, the contact edge of the blade is seriously abraded as illustrated in FIGS. 22B and 23. In this case, residual toner particles pass through the abraded portions of the blade as illustrated in FIG. 24B, and therefore the residual toner passing the nip between the blade and the photoreceptor has a broad q/d distribution curve as illustrated in FIG. 25. Therefore, the toner particles cannot be efficiently removed from the photoreceptor 1 by the cleaning brush 23.

By using a blade having an obtuse edge as the toner polarity controlling blade 22, the polarity controlling performance of the blade can be enhanced while maintaining the good scraping function of the blade. When such an obtuse edge is contacted with a rotated photoreceptor as illustrated in FIG. 12A, the edge is not easily deformed even when pulled in the rotation direction of the photoreceptor by the friction force caused by the rotated photoreceptor compared to the case of using a blade having a right-angle edge. Specifically, the edge is slightly turned in the rotation direction of the photoreceptor as illustrated in FIG. 12B. Therefore, variation of the nip width and the gap (i.e., area of the discharge occurring region Z) can be minimized.

Next, the difference between a blade having an obtuse edge and a blade having a right-angle edge will be explained.

Figure 13A:
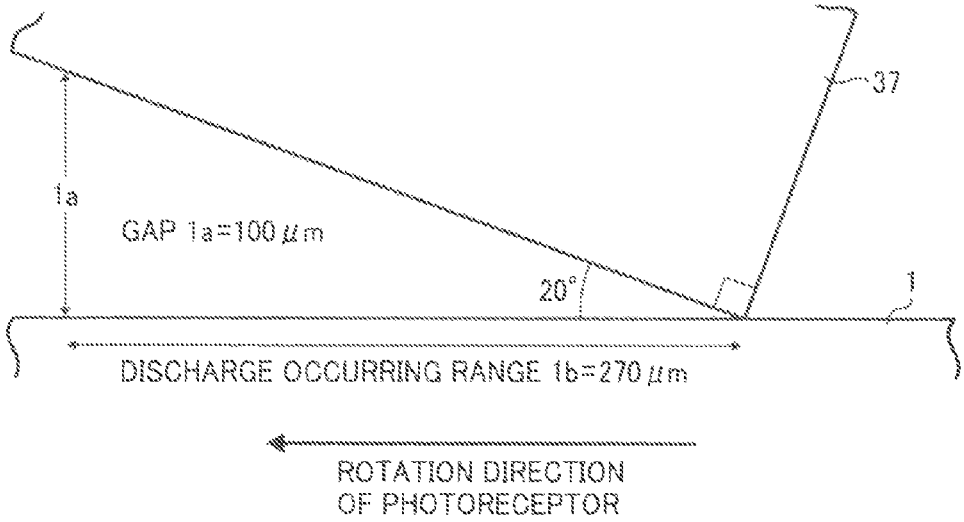
FIGS. 13A and 13*b* illustrate the tip portion of the blade illustrated in FIG. 11.

At first, a case where a blade 37 having a right-angle edge is set in such a manner as illustrated in FIG. 13A is explained. In this regard, the properties and setting conditions of the blade 37 are as follows.

Cover layer: No cover layer

Thickness: 2 mm

Length of free portion (i.e., the portion of the blade not supported by the holder): 7 mm JIS A hardness: 60-80

Repulsive elastic coefficient: 30%

Contact angle: 20°

Penetration depth of blade to photoreceptor: 0.5 mm (i.e., the blade is curved on the photoreceptor by a length of 0.5 mm)

Angle of edge of blade: 90°

Figure 13B:
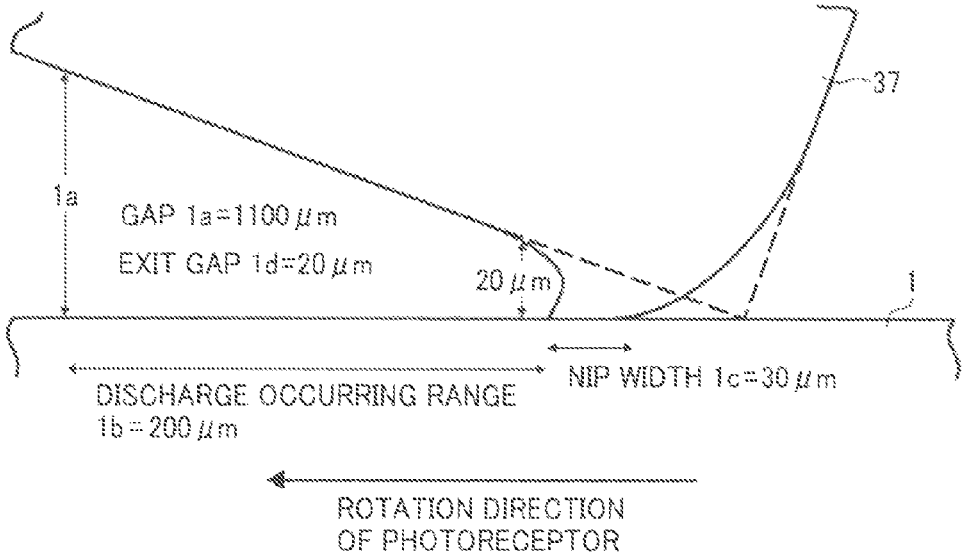

When the blade having a right-angle edge is contacted with a photoreceptor and the photoreceptor is rotated at a linear speed of 100 mm/s, the blade causes sticking and slipping and the blade has a nip width 1*c* of about 30 μm at a maximum as illustrated in FIG. 13B. In this case, the gap 1*d* at the exit side of the blade is about 20 μm. When a voltage of −1,000V is applied to the blade, the dischargeable gap 1*a*, within which discharge occurs between the surface of the blade and the surface of the photoreceptor, is about 100 μm. In this case, as illustrated in FIG. 13B, the discharge occurring range 1*b* is about 200 μm, which is largely different from the discharge occurring range (i.e., 270 μm) when the blade having the initial state as illustrated in FIG. 13A.

Figure 14A:
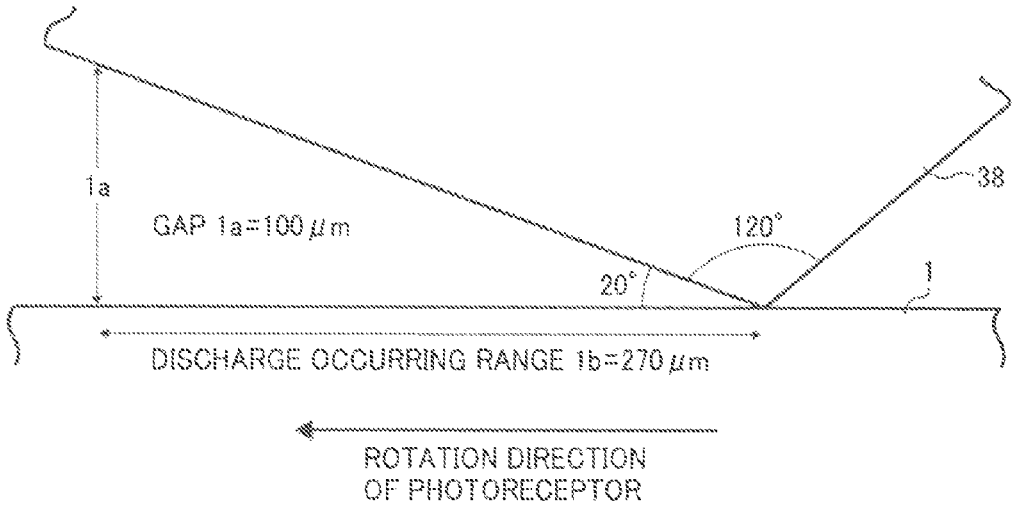
FIGS. 14A and 14*b* illustrate the tip portion of the blade illustrated in FIG. 12.
Figure 14B:
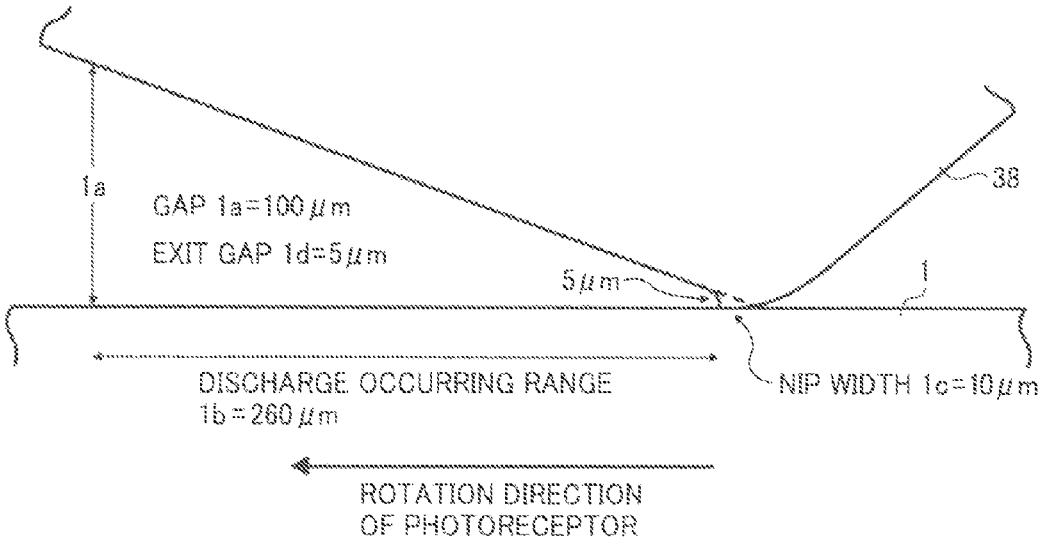

In contrast, when a blade 38 having an obtuse edge (120°) is contacted with the photoreceptor as illustrated in FIG. 14 (properties of the blade and setting conditions are the same except for the angle of the edge), the nip width is about 10 μm at a maximum as illustrated in FIG. 14B. In this case, the gap 1*d* at the exit side of the blade 38 is about 5 μm, and the discharge occurring range is about 260 μm, which is almost the same as the initial discharge occurring range (i.e., 270 μm) illustrated in FIG. 14A. In this regard, the blade illustrated in FIG. 14 has no cover layer on the edge thereof.

Figure 15:
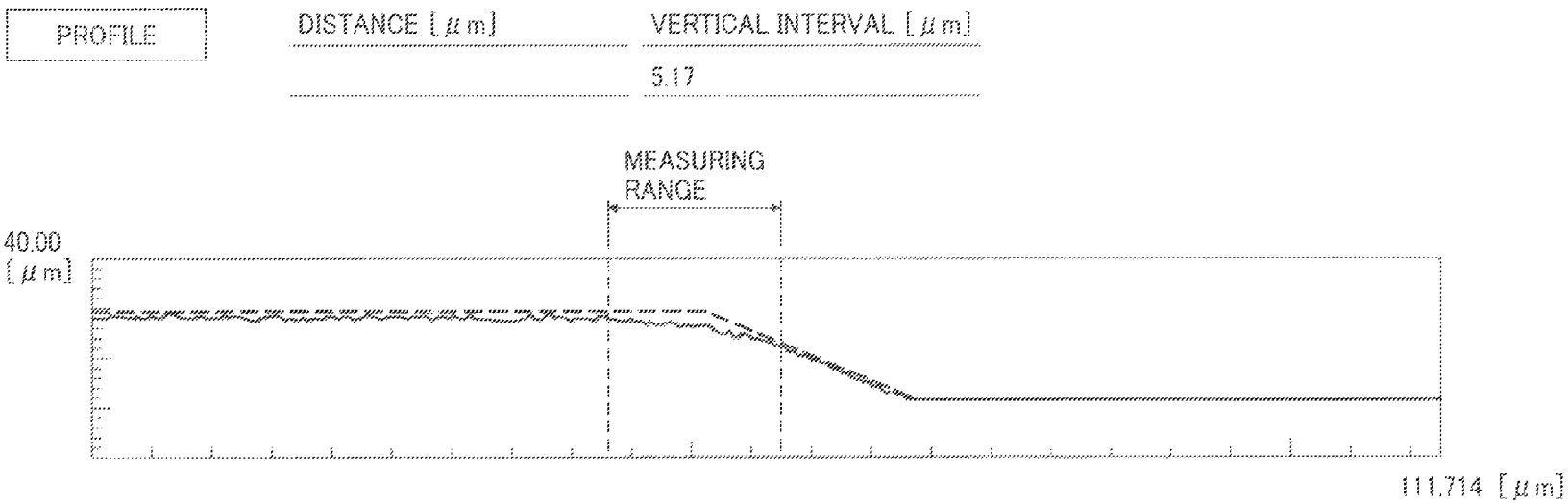
FIG. 15 illustrates the profile of the edge portion of a blade, which is not coated with a resin and which has an obtuse angle, after the blade is used for cleaning.

As the variation of the nip width decreases, the amount of charges injected into the toner particles at the nip becomes more stable. In addition, as the variation of the discharge occurring region decreases, the amount of charges supplied to the toner particles due to discharge becomes more stable. Further, as illustrated in FIG. 15, the degree of abrasion of the contact edge of the blade 38 having an obtuse edge is less than that of the blade 37 having a right-angle edge (illustrated in FIG. 23).

Figure 8:
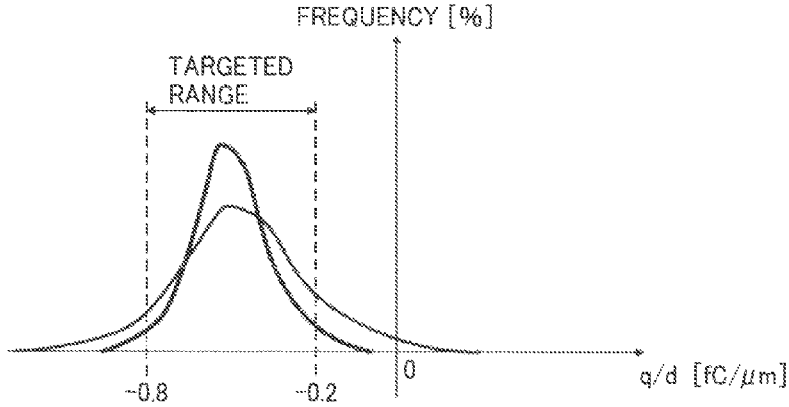
FIG. 8 is a graph illustrating an example of the charge (q/d) distribution curve of toner charged by the polarity controlling device of the present invention.
Figure 10:
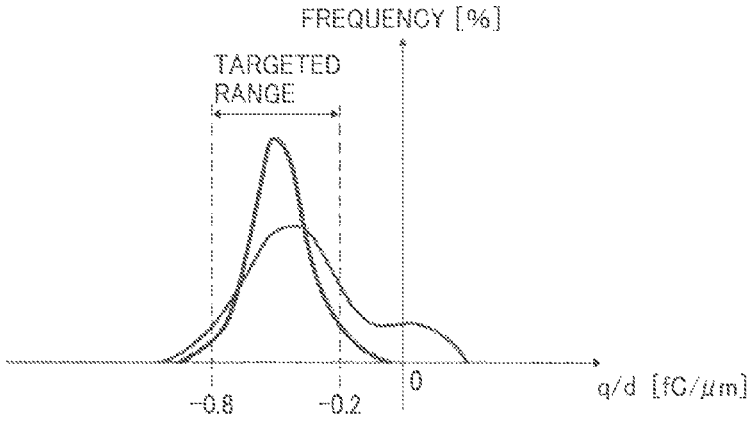
FIG. 10 is a graph illustrating another example of the charge (q/d) distribution of toner charged by the polarity controlling device of the present invention.

Thus, by using the blade 38 having an obtuse edge, the polarity of the residual toner particles can be stably controlled, and therefore the resultant charged toner particles have a narrow q/d distribution curve as illustrated by the heavy line in FIG. 8. In addition, since the degree of abrasion is small even after long repeated use, the blade 38 hardly causes the problem in that residual toner particles pass through the abraded portions of the blade without being charged, thereby broadening the q/d distribution curve. Therefore, the toner particles charged by the blade 38 have such a narrow q/d distribution curve as illustrated in FIG. 10.

Example 7

Next, a case of using a blade having a resin-coated obtuse edge will be explained.

Figure 16A:
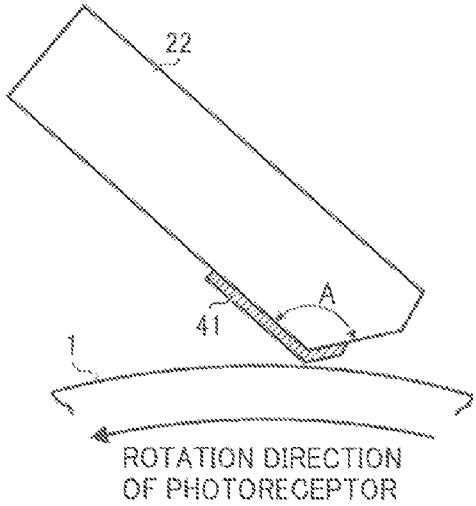
FIGS. 16A and 16B illustrate blades having a resin coated edge for use in the polarity controlling device of the present invention.
Figure 16B:
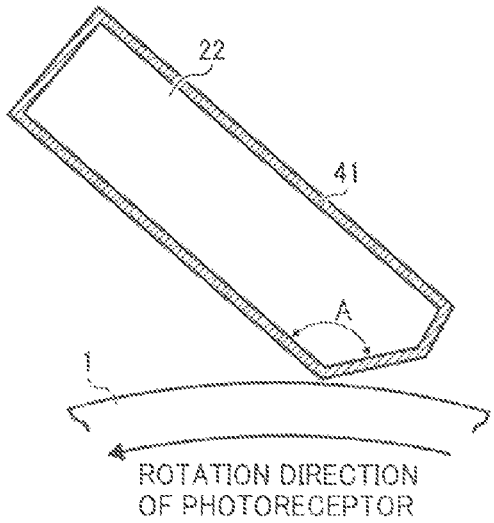

As illustrated in FIGS. 16A and 16B, a blade having an obtuse edge and the cover layer 41, which is formed on at least the edge portion to be contacted with the photoreceptor, is used as the toner polarity controlling blade 22. In this regard, the properties and setting conditions of the blade are the same as those of the blade 38 mentioned above except that the blade has the cover layer 41. As mentioned above, the cover layer 41 includes an electroconductive agent and has a low friction coefficient and a high hardness.

By using such a blade, variation of the blade (such as variation in nip width and discharge occurring region) can be further reduced, and the abrasion resistance of the blade can be further enhanced. Therefore, the residual toner particles charged by this blade have a sharper q/d distribution curve.

Specific examples of the cover layer 41 include polymers and copolymers including a unit obtained from the compounds mentioned above. In addition, specific examples of the electroconductive agent include the materials mentioned above. The cover layer 41 is preferably thin so as not to deteriorate the dimensional precision and properties of the blade, and the thickness thereof is preferably from 2 μm to 10 μm in consideration of the life thereof and the above-mentioned factors.

The cover layer 41 preferably has a high hardness and a low friction coefficient. In order to impart a high hardness to the cover layer, the resin included in the layer preferably has a pencil hardness of from B to 6H. In order to impart a low friction coefficient to the cover layer, the resin included in the layer preferably has a contact angle of from 85° to 140° against pure water.

Example 8

Another example of the image forming apparatus of the present invention, i.e., a multi-color image forming apparatus, will be explained.

Figure 17:
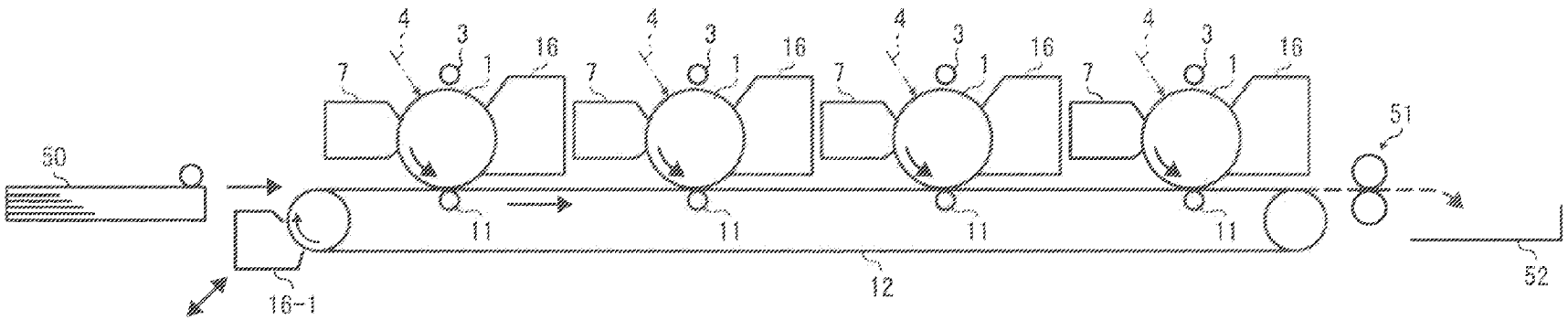
FIGS. 17-19 illustrate examples (multi-color image forming apparatus) of the image forming apparatus of the present invention.

The example image forming apparatus is a tandem-type multi-color image forming apparatus illustrated in FIG. 17, in which color images formed on plural image bearing members (photoreceptors in this example) are directly transferred to a receiving material sheet to form a multi-color image thereon.

Referring to FIG. 17, the tandem-type multi-color image forming apparatus includes four photoreceptors 1 for forming cyan, magenta, yellow and black toner images thereon, which are arranged side by side so as to face the transfer belt 12. The color toner images formed on the photoreceptors 1 are transferred one by one onto a receiving material sheet, which is fed by a receiving material feeding device 50 and fed by the transfer belt 12, so that the color toner images are overlaid, resulting in formation of a combined multi-color image on the receiving material sheet. After the combined multi-color image on the receiving material sheet is fixed by a fixing device 51, the receiving material sheet is discharged on a tray 52 as a copy.

Similarly to the image forming apparatus illustrated in FIG. 1, image formation processing devices (e.g., charger 3, developing device 7, transfer roller 11 and cleaner 16) are arranged around each of the photoreceptors 1. In FIG. 17, numeral 4 denotes light beams emitted from a light irradiating device to form electrostatic images on the photoreceptors 1.

Toner particles remaining on the photoreceptors 1 even after the transfer processes are removed therefrom by the respective cleaners 16. In addition, toner particles remaining on the transfer belt 12 are removed therefrom by the belt cleaner 16-1 similarly to the image forming apparatus illustrated in FIG. 1.

Example 9

Yet another example of the image forming apparatus of the present invention, i.e., a multi-color image forming apparatus, will be explained.

Figure 18:
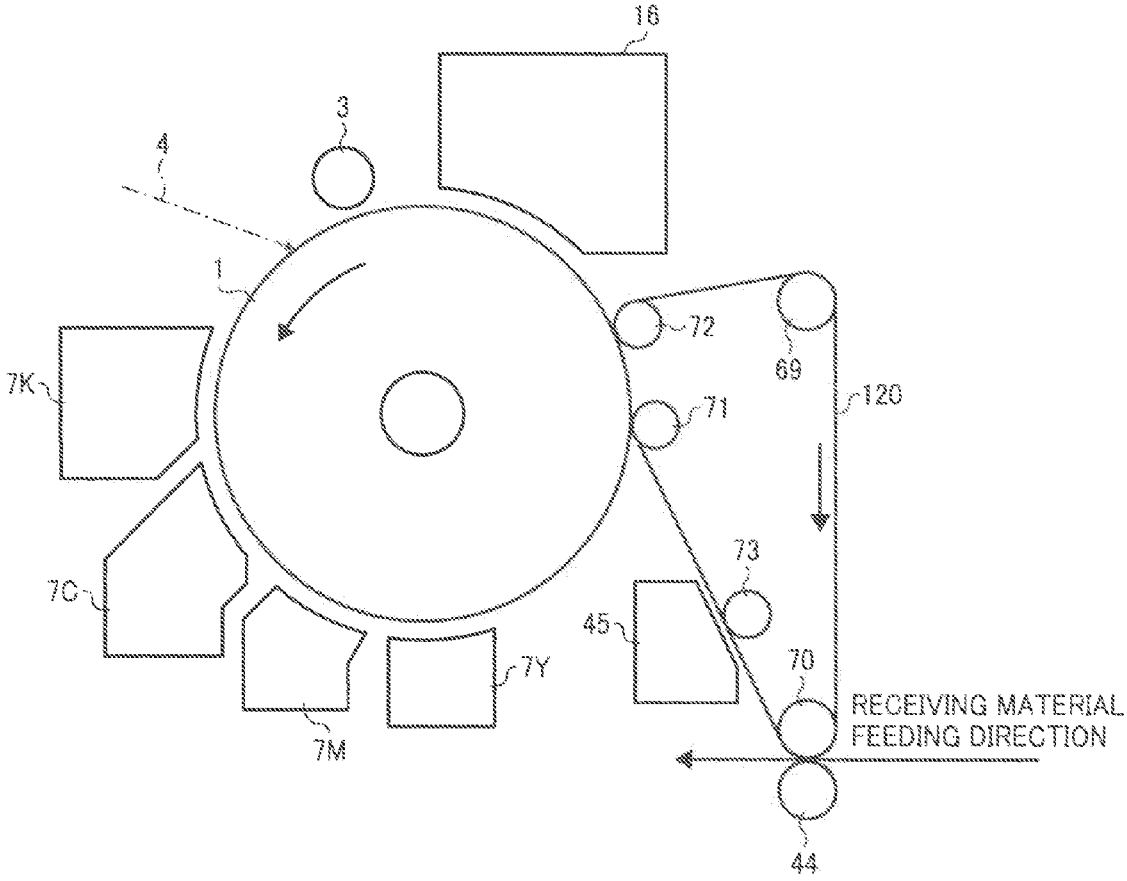

The multi-color image forming apparatus is illustrated in FIG. 18 has one photoreceptor serving as an image bearing member, and plural developing devices. This example multi-color image forming apparatus includes four developing devices, i.e., a developing device 7K for forming black toner images, a developing device 7C for forming cyan toner images, a developing device 7M for forming magenta toner images, and a developing device 7Y for forming yellow toner images.

The image forming apparatus further includes an intermediate transfer belt 120, which is located on a downstream side from the developing device 7Y in the rotation direction of the photoreceptor 1. The intermediate transfer belt 120 is supported by rollers 69, 70, 71 and 72. A part of the intermediate transfer belt 120 is contacted with the photoreceptor 1 by the rollers 71 and 72. The rollers 71 and 72 serves as a primary transfer member configured to transfer a toner image on the photoreceptor 1 to the intermediate transfer belt 120. After forming four color toner images (i.e., yellow, magenta, cyan and black toner images) one by one on the photoreceptor 1, the color toner images are transferred onto the intermediate transfer belt 120, resulting in formation of a combined multi-color toner image on the intermediate transfer belt 120. The combined multi-color toner image on the intermediate transfer belt 120 is then transferred onto a receiving material sheet, which is timely fed from a feeding device (not shown), at a nip between the roller 70 and a roller 44, which serve as a secondary transfer member. The combined multi-color toner image on the receiving material sheet is fixed by a fixing device, and the receiving material sheet bearing the fixed multi-color toner image is discharged from the multi-color image forming apparatus.

By irradiating the photoreceptor 1 with light including color image information, an electrostatic latent image corresponding to the color image is formed on the photoreceptor. One of the developing devices 7 develops the electrostatic latent image using a developer including a toner having a color corresponding to the color image to prepare a color toner image on the photoreceptor. The color toner image is then transferred onto the intermediate transfer belt 120 (primary transfer). By repeating this image forming operation for all the color images, K, C, M and Y color toner images are overlaid on the intermediate transfer belt 120, resulting in formation of a combined multi-color toner image on the intermediate transfer belt 120.

The thus prepared combined multi-color toner image is secondarily transferred onto a receiving material sheet, which has been timely fed to the transfer nip between the rollers 70 and 44. The combined multi-color toner image on the receiving material sheet is fixed by a fixing device (not shown), and the receiving material sheet bearing the fixed multi-color toner image (i.e., a full color image) is discharged from the multi-color image forming apparatus.

After a color toner image is transferred to the intermediate transfer belt 120, charged materials (such as toner particles) remaining on the photoreceptor 1 are removed therefrom by the cleaner 16, which has configuration similar to that of the cleaner illustrated in FIG. 1 and which is located between the roller 72 and the noncontact charging roller 3.

In addition, after a combined multi-color toner image is transferred onto a receiving material sheet, charged materials (such as toner particles) remaining on the intermediate transfer belt 120 are removed therefrom by a cleaner 45, which has configuration similar to that of the cleaner 16-1 illustrated in FIG. 1 and which is located so as to be opposed to a support roller 73 contacting the inner surface of the intermediate transfer belt 120.

Example 10

A further example of the image forming apparatus of the present invention, i.e., a tandem multi-color image forming apparatus using an intermediate transfer method, will be explained.

Figure 19:
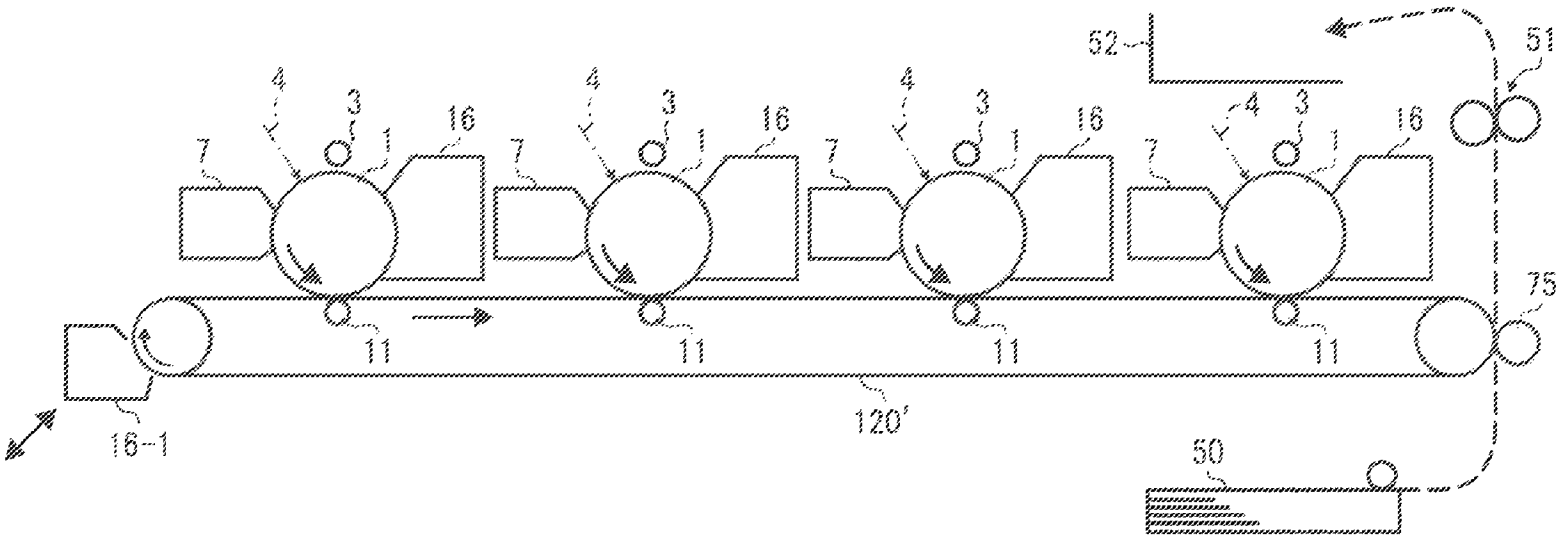

The multi-color image forming apparatus illustrated in FIG. 19 is different from the image forming apparatus illustrated in FIG. 17 in that the feeding belt 12 is replaced with an intermediate transfer belt 120'.

In the multi-color image forming apparatus, plural photoreceptors (four photoreceptors in this case) are arranged side by side along the intermediate transfer belt 120'. Color toner images formed on the photoreceptors similarly to the image forming apparatus of Example 8 are primarily transferred one by one onto the intermediate transfer belt 120' by the transfer rollers 11 to form a combined multi-color toner image on the intermediate transfer belt. The combined multi-color toner image is then transferred onto a receiving material sheet, which has been fed from the receiving material feeding device 50, at the right end of the intermediate transfer belt 120' by a secondary transfer roller 75. The combined multi-color toner image is then fixed by the fixing device 51. The receiving material sheet bearing a fixed multi-color image (such as full color images) thereon is then discharged from the image forming apparatus.

Similarly to the image forming apparatus of Example 8 illustrated in FIG. 17, the cleaners 16 and 16-1, which are mentioned above in Example 1, are provided in the image forming apparatus of Example 10 to remove residual materials on the photoreceptors 1 and residual materials on the intermediate transfer belt 120', respectively.

This document claims priority and contains subject matter related to Japanese Patent Application No. 2008-206442, filed on Aug. 8, 2008, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A cleaner comprising:

a polarity controlling device for controlling a polarity of a residual material on a surface of an image bearing member, the polarity controlling device including a blade, to which a voltage is applied and which has a contact edge contacted with the surface of the image bearing member to charge the residual material so as to have a charge with a polarity when the residual material passes through a nip between the contact edge of the blade and the surface of the image bearing member, wherein the contact edge of the blade is covered with a cover layer including a resin and an electroconductive material dispersed in the resin;

a brush, to which a second voltage having a second polarity opposite to the polarity of the voltage applied to the blade of the polarity controlling device is applied and which contacts the image bearing member to electrostatically collect the residual material on the surface of the image bearing member after the residual material is charged by the blade of the polarity controlling device;

a collection member, to which a third voltage having the second polarity and being greater than the second voltage is applied and which contacts the brush to electrostatically collect the residual material on the surface of the brush; and a collection member cleaning blade, to which a fourth voltage having the second polarity and being greater than the third voltage is applied and which contacts the collection member to scrape the residual material from the surface of the collection member.

2. The cleaner according to claim 1, wherein the resin included in the cover layer has a contact angle of from 85° to 140° against pure water.

3. The cleaner according to claim 1, wherein the resin included in the cover layer has a pencil hardness of from B to 6H.

4. The cleaner according to claim 1, wherein the resin in the cover layer is selected from the group consisting of polymers and copolymers including a unit obtained from a compound selected from the group consisting of trimethylolpropane triacrylate, trimethylolpropane trimethacrylate, neopentylglycol diacrylate, neopentylglycol dimethacrylate, pentaerythritol triacrylate, pentaerythritol trimethacrylate, pentaerythritol tetraacrylate, pentaerythritol tetramethacrylate, trimethylolethane triacrylate, trimethylolethane trimethacrylate, tetramethylolmethane tetraacrylate, tetramethylolmethane tetramethacrylate, oligoester acrylate, and oligoester methacrylate.

5. The cleaner according to claim 4, wherein the residual material consists essentially of toner having a shape factor SF-1 of from 100 to 150.

6. The cleaner according to claim 4, wherein the contact edge has an obtuse angle.

7. An image forming apparatus comprising:

at least one image bearing member configured to bear at least one electrostatic image thereon;

at least one developing device configured to develop the at least one electrostatic image with at least one developer including a toner to form at least one toner image on the at least one image bearing member;

a transfer device configured to transfer the at least one toner image onto a receiving material; and at least one cleaner according to claim 4 configured to remove residual material on the at least one image bearing member.

8. The image forming apparatus according to claim 7, wherein the image bearing member is a photoreceptor including a photosensitive layer and an outermost layer located overlying the photosensitive layer, and wherein the outermost layer is a filler-reinforced layer or a layer including a crosslinked charge transport material.

9. The image forming apparatus according to claim 7, wherein the image bearing member is an amorphous silicon photoreceptor.

10. The image forming apparatus according to claim 7, further comprising:

a feeding belt configured to feed the receiving material so that the at least one toner image is transferred onto the receiving material by the transfer device; and a belt cleaner configured to clean a surface of the feeding belt, wherein the belt cleaner has a structure of said at least one cleaner.

11. The image forming apparatus according to claim 7, further comprising:

plural developing devices configured to develop plural electrostatic images on the image bearing member with respective developers including different color toners to form different color toner images on the at least one image bearing member, wherein the transfer device transfers the different color toner images onto the receiving material one by one to form a combined multi-color toner image on the receiving material.

12. The image forming apparatus according to claim 7, including plural image forming members, plural cleaners, and plural developing devices configured to develop plural electrostatic images on the plural image bearing members with respective developers including different color toners to form different color toner images on the plural image bearing members, wherein the surfaces of the plural image bearing members are cleaned by the respective plural cleaners.

13. The image forming apparatus according to claim 12, further comprising:

an intermediate transfer belt, to which the transfer device transfers the plural toner images from the plural image bearing members to form a combined multi-color toner image on the intermediate transfer belt, followed by transferring the combined multi-color toner image onto the receiving material; and a belt cleaner configured to clean a surface of the intermediate transfer belt, wherein the belt cleaner has a structure of said at least one cleaner.

14. The image forming apparatus according to claim 7, wherein the at least one image bearing member and the at least one cleaner are unitized as a process cartridge, which optionally includes one or more other members selected from chargers configured to charge the at least one image bearing member and the at least one developing device, and wherein the process cartridge is detachably attachable to the image forming apparatus.

* * * * *